US009291316B2

(12) United States Patent
Dixon et al.

(10) Patent No.: US 9,291,316 B2
(45) Date of Patent: Mar. 22, 2016

(54) INTEGRATED LINEAR LIGHT ENGINE

(71) Applicant: CREE, INC., Durham, NC (US)

(72) Inventors: Mark Edward Dixon, Morrisville, NC (US); John Durkee, Raleigh, NC (US); Nicholas W. Medendorp, Jr., Raleigh, NC (US); Paul Kenneth Pickard, Morrisville, NC (US); Antony Van De Ven, Sai Kung (HK)

(73) Assignee: CREE, INC., Durham, NC (US)

( * ) Notice: Subject to any disclaimer, the term of this patent is extended or adjusted under 35 U.S.C. 154(b) by 57 days.

(21) Appl. No.: 13/840,812

(22) Filed: Mar. 15, 2013

(65) Prior Publication Data

US 2014/0126197 A1 May 8, 2014

Related U.S. Application Data

(63) Continuation of application No. 13/782,820, filed on Mar. 1, 2013, which is a continuation-in-part of application No. 13/672,592, filed on Nov. 8, 2012.

(51) Int. Cl.

| | |
|---|---|
| ***F21L 4/00*** | (2006.01) |
| ***F21V 7/00*** | (2006.01) |
| ***F21V 21/00*** | (2006.01) |
| ***F21K 99/00*** | (2010.01) |
| ***F21S 8/06*** | (2006.01) |

(Continued)

(52) U.S. Cl.

CPC ... *F21L 4/00* (2013.01); *F21K 9/30* (2013.01); *F21S 8/063* (2013.01); *F21V 7/00* (2013.01); *F21V 21/00* (2013.01); *F21V 21/112* (2013.01); *F21Y 2103/003* (2013.01)

(58) Field of Classification Search

USPC ..... 362/218, 217.14

See application file for complete search history.

(56) References Cited

U.S. PATENT DOCUMENTS

| | | | | |
|---|---|---|---|---|
| 4,118,763 | A | 10/1978 | Osteen | 359/833 |
| 4,300,185 | A | 11/1981 | Wakamatsu | 362/147 |
| 4,472,767 | A | 9/1984 | Wenman | 362/147 |

(Continued)

FOREIGN PATENT DOCUMENTS

| | | |
|---|---|---|
| DE | 102007030186 | 1/2009 |
| DE | 202010001832 | 7/2010 |

(Continued)

OTHER PUBLICATIONS

International Search Report and Written Opinion from PCT Application No. PCT/US2013/021053, dated Apr. 17, 2013.

(Continued)

*Primary Examiner* — Anne Hines

(74) *Attorney, Agent, or Firm* — Koppel, Patrick, Heybl & Philpott

(57) ABSTRACT

This disclosure relates to light engines for use in lighting fixtures, such as troffer-style lighting fixtures. Light engines according to the present disclosure have integrated features that eliminate the need for additional components such as a Printed Circuit Board (PCB), a heat sink, a cover portion, a lens and/or a reflective element. Devices according to this disclosure can comprise a rigid body, conductive elements arranged into electrical pathways and light sources such as light emitting diodes (LEDs). Devices according to this disclosure can further comprise integrated cover, lens and/or reflective element features. Methods for the manufacture of such devices are also disclosed.

21 Claims, 11 Drawing Sheets

(51) Int. Cl.
*F21V 21/112* (2006.01)
*F21Y 103/00* (2006.01)

(56) References Cited

U.S. PATENT DOCUMENTS

| | | | | |
|---|---|---|---|---|
| 4,946,547 | A | 8/1990 | Palmour et al. | |
| 5,200,022 | A | 4/1993 | Kong et al. | |
| RE34,861 | E | 2/1995 | Davis et al. | |
| 5,530,628 | A | 6/1996 | Ngai | 362/127 |
| 5,690,415 | A | 11/1997 | Krehl | 362/125 |
| 5,823,663 | A | 10/1998 | Bell et al. | 362/362 |
| 5,951,150 | A | 9/1999 | Helstern | 362/293 |
| 6,210,025 | B1 | 4/2001 | Schmidt et al. | 362/362 |
| 6,536,924 | B2 | 3/2003 | Segretto | 362/345 |
| 6,667,451 | B1 | 12/2003 | Hart | 200/314 |
| 6,739,734 | B1 | 5/2004 | Hulgan | 362/243 |
| 6,914,194 | B2 | 7/2005 | Fan | |
| 7,049,761 | B2 | 5/2006 | Timmermans et al. | 315/246 |
| 7,213,940 | B1 | 5/2007 | Van de Ven et al. | |
| 7,217,023 | B2 | 5/2007 | Iwasa et al. | 362/555 |
| 7,228,253 | B2 | 6/2007 | Chen | 318/11 |
| 7,387,410 | B2 | 6/2008 | Sibout | 362/375 |
| 7,510,299 | B2 | 3/2009 | Timmermans et al. | 362/225 |
| 7,540,627 | B2 | 6/2009 | Handsaker | 362/225 |
| 7,594,736 | B1 | 9/2009 | Kassay et al. | |
| 7,628,506 | B2 | 12/2009 | Verfuerth et al. | 362/218 |
| 7,654,702 | B1 | 2/2010 | Ding et al. | |
| 7,654,703 | B2 | 2/2010 | Kan et al. | 362/362 |
| 7,712,918 | B2 | 5/2010 | Siemiet et al. | 362/241 |
| 7,722,220 | B2 | 5/2010 | Van de Ven | 362/294 |
| 7,758,207 | B1 | 7/2010 | Zhou et al. | 362/218 |
| 7,768,192 | B2 | 8/2010 | Van de Ven et al. | 313/503 |
| 7,791,061 | B2 | 9/2010 | Edmond et al. | |
| 7,815,338 | B2 | 10/2010 | Siemiet et al. | 362/218 |
| 8,058,088 | B2 | 11/2011 | Cannon et al. | |
| 8,092,049 | B2 | 1/2012 | Kinnune et al. | 362/294 |
| 8,201,968 | B2 | 6/2012 | Maxik et al. | |
| 8,206,004 | B2 | 6/2012 | Serak et al. | 362/217 |
| 8,313,212 | B1 | 11/2012 | Mayer et al. | 362/219 |
| 8,317,369 | B2 | 11/2012 | McCanless | 362/368 |
| 8,376,578 | B2 | 2/2013 | Kong, II | 362/241 |
| 8,459,824 | B1 | 6/2013 | Esmailzadeh et al. | 362/147 |
| 8,523,383 | B1 | 9/2013 | Grigore et al. | 362/221 |
| 8,714,770 | B2 | 5/2014 | Kato | |
| 8,764,220 | B2 | 7/2014 | Chan et al. | 362/217.02 |
| 9,057,493 | B2 | 6/2015 | Simon | |
| 2001/0048599 | A1 | 12/2001 | Hess | 362/290 |
| 2004/0001344 | A1 | 1/2004 | Hecht | |
| 2004/0240214 | A1 | 12/2004 | Whitlow et al. | 362/373 |
| 2004/0252521 | A1 | 12/2004 | Clark | 362/554 |
| 2005/0146867 | A1 | 7/2005 | Kassay | |
| 2006/0050505 | A1 | 3/2006 | McCarthy | 362/219 |
| 2006/0266955 | A1 | 11/2006 | Arvin | 250/492.1 |
| 2007/0115670 | A1 | 5/2007 | Roberts et al. | |
| 2007/0115671 | A1 | 5/2007 | Roberts et al. | |
| 2007/0158668 | A1 | 7/2007 | Tarsa et al. | |
| 2008/0049422 | A1 | 2/2008 | Trenchard et al. | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0232093 | A1 | 9/2008 | Kim | |
| 2008/0258130 | A1 | 10/2008 | Bergmann et al. | |
| 2008/0285267 | A1 | 11/2008 | Santoro | 362/224 |
| 2008/0314944 | A1 | 12/2008 | Tsai et al. | 224/331 |
| 2009/0040782 | A1 | 2/2009 | Liu et al. | 362/555 |
| 2009/0046457 | A1 | 2/2009 | Everhart | 362/235 |
| 2009/0161356 | A1 | 6/2009 | Negley et al. | 362/231 |
| 2009/0184333 | A1 | 7/2009 | Wang et al. | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0225543 | A1 | 9/2009 | Roberts et al. | |
| 2009/0237958 | A1 | 9/2009 | Kim | |
| 2009/0290345 | A1 | 11/2009 | Shaner | 362/249.01 |
| 2009/0290348 | A1 | 11/2009 | Van Laanen et al. | 362/249 |
| 2009/0296381 | A1 | 12/2009 | Dubord | 362/218 |
| 2009/0323334 | A1 | 12/2009 | Roberts et al. | |
| 2010/0142205 | A1 | 6/2010 | Bishop | 362/249.02 |
| 2010/0155763 | A1 | 6/2010 | Donofrio et al. | |
| 2010/0171404 | A1 | 7/2010 | Liu et al. | 313/46 |
| 2010/0214770 | A1 | 8/2010 | Anderson | 362/133 |
| 2010/0214785 | A1 | 8/2010 | Chen | 362/267 |
| 2010/0220469 | A1* | 9/2010 | Ivey et al. | 362/218 |
| 2010/0254146 | A1 | 10/2010 | McCanless | |
| 2010/0328945 | A1 | 12/2010 | Song et al. | 362/240 |
| 2011/0007514 | A1 | 1/2011 | Sloan | 362/368 |
| 2011/0013400 | A1 | 1/2011 | Kanno et al. | |
| 2011/0028006 | A1 | 2/2011 | Shah et al. | 439/39 |
| 2011/0103043 | A1 | 5/2011 | Ago | 362/147 |
| 2011/0163683 | A1 | 7/2011 | Steele et al. | 315/192 |
| 2011/0199005 | A1 | 8/2011 | Bretschneider et al. | |
| 2011/0199769 | A1 | 8/2011 | Bretschneider et al. | |
| 2011/0211330 | A1 | 9/2011 | Wang | 362/20 |
| 2011/0285314 | A1 | 11/2011 | Carney et al. | 315/294 |
| 2011/0286207 | A1 | 11/2011 | Chan et al. | 362/217.1 |
| 2011/0310604 | A1 | 12/2011 | Shimizu et al. | 362/235 |
| 2012/0002408 | A1 | 1/2012 | Lichten et al. | 362/218 |
| 2012/0051041 | A1 | 3/2012 | Edmond et al. | 362/231 |
| 2012/0075857 | A1 | 3/2012 | Verbrugh | 362/249 |
| 2012/0081883 | A1 | 4/2012 | Wang | 362/101 |
| 2012/0120666 | A1 | 5/2012 | Moeller | 362/308 |
| 2012/0169234 | A1 | 7/2012 | Shew | 315/88 |
| 2012/0182755 | A1 | 7/2012 | Wildner | 362/555 |
| 2012/0218757 | A1 | 8/2012 | Gill | 362/235 |
| 2012/0235199 | A1 | 9/2012 | Andrews et al. | |
| 2013/0039090 | A1 | 2/2013 | Dau | 362/551 |
| 2013/0050998 | A1* | 2/2013 | Chu et al. | 362/218 |
| 2013/0094225 | A1 | 4/2013 | Leichner | 362/368 |
| 2013/0155670 | A1 | 6/2013 | Handsaker | 362/223 |
| 2013/0271979 | A1 | 10/2013 | Pearson et al. | 362/235 |
| 2013/0279180 | A1 | 10/2013 | Pearson et al. | 362/371 |
| 2013/0329425 | A1 | 12/2013 | Lowes et al. | |
| 2014/0265809 | A1 | 9/2014 | Hussell | |

FOREIGN PATENT DOCUMENTS

| | | | |
|---|---|---|---|
| EP | 1298383 | A2 | 4/2003 |
| EP | 1357335 | A2 | 10/2003 |
| EP | 1847762 | A2 | 10/2007 |
| JP | 2011018571 | | 8/2011 |
| JP | 2011018572 | | 8/2011 |
| WO | WO 03102467 | | 12/2003 |
| WO | WO 2008003289 | | 1/2008 |
| WO | WO 2009140761 | A1 | 11/2009 |
| WO | WO 2010042216 | A2 | 4/2010 |
| WO | WO 2011074424 | A1 | 6/2011 |
| WO | WO 2011096098 | A1 | 8/2011 |
| WO | WO 2011140353 | A2 | 11/2011 |

OTHER PUBLICATIONS

XLamp® C family from Cree®, Inc., Product Family Data Sheet, 15 pages.

XLamp® M family from Cree®, Inc., Product Family Data Sheet, 14 pages.

XLamp®X family from Cree®, Inc., Product Family Data Sheet, 17 pages.

Energy Star® Program Requirements for Solid State Lighting Luminaires, Eligibility Criteria—Version 1.1. final: Dec. 19, 2008.

Assist Recommends . . . LED Life for General Lighting: Definition of Life. vol. 1, Issue 1, Feb. 2005.

"IES Approved Method for Measuring Lumen Maintenance of LED light Sources", Sep. 22, 2008, ISBN No. 978-0-87995-227-3, (LM-80).

U.S. Appl. No. 13/649,052, filed Oct. 10, 2012, Lowes, et al.

U.S. Appl. No. 13/649,067, filed Oct. 10, 2012, Lowes, et al.

U.S. Appl. No. 13/207,204, filed Aug. 10, 2011, Athalye, et al.

U.S. Appl. No. 13/365,844.

U.S. Appl. No. 13/662,618, filed Oct. 29, 2012.

U.S. Appl. No. 13/462,388, filed May 2, 2012.

Notice to Submit a Response from Korean Patent Application No. 30-2011-0038115, dated Dec. 12, 2012.

(56) References Cited

OTHER PUBLICATIONS

Notice to Submit a Response from Korean Patent Application No. 30-2011-0038116, dated Dec. 12, 2012.
International Search Report and Written Opinion for PCT Application No. PCT/US2011/062396, dated Jul. 13, 2012.
International Search Report and Written Opinion for Patent Application No. PCT/US2011/001517, dated: Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
Office Action from Japanese Design Patent Application No. 2011-18570.
Reason for Rejection from Japanese Design Patent Application No. 2011-18571.
Reason for Rejection from Japanese Design Patent Application No. 2011-18572.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet, 1 page, from www.leviton.com.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 13/829,558, dated Sep. 30, 2014.
Office Action from U.S. Appl. No. 29/450,263, dated Nov. 5, 2014.
Office Action from U.S. Appl. No. 29/449,316, dated Nov. 26, 2014.
Office Action from U.S. Appl. No. 13/763,270, dated Oct. 3, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.
Office Action from U.S. Appl. No. 13/834,605, dated Apr. 9, 2015.
Office Action from U.S. Appl. No. 13/910,486, dated May 7, 2015.
Office Action from U.S. Appl. No. 13/763,270, dated May 19, 2015.
Office Action from U.S. Appl. No 14/252,685, dated Oct. 1, 2015.
Office Action from U.S. Appl. No 13/958,461, dated Oct. 15, 2015.
Office Action from U.S. Appl. No 13/910,486, dated Oct. 15, 2015.
Response to OA from U.S. Appl. No 13/910,486, filed Dec. 15, 2015.
Office Action from U.S. Appl. No 13/782,820, dated Oct. 30, 2015.
Office Action from U.S. Appl. No 13/899,314, dated Nov. 13, 2015.
Response to OA from U.S. Appl. No 13/899,314, filed Dec. 16, 2015.
Office Action from U.S. Appl. No 13/672,592, dated Nov. 23, 2015.
Office Action from U.S. Appl. No 14/020,752, dated Dec. 14, 2015.

* cited by examiner

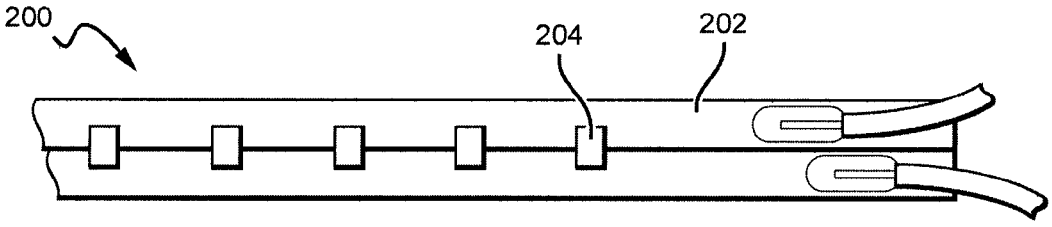
FIG. 3
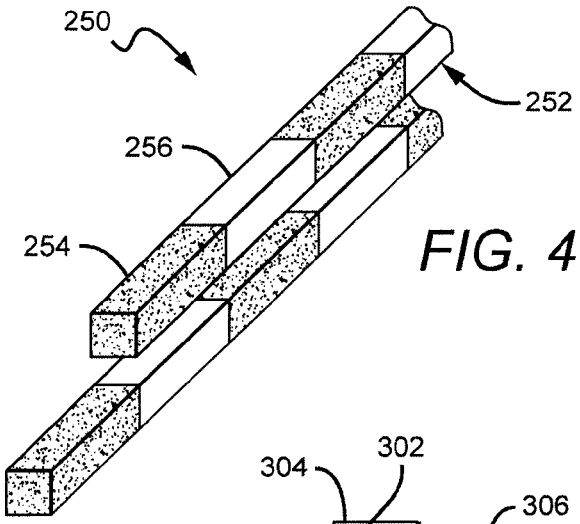
FIG. 4
FIG. 5
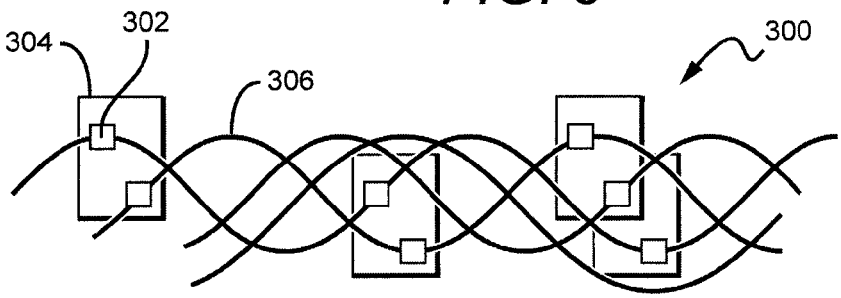
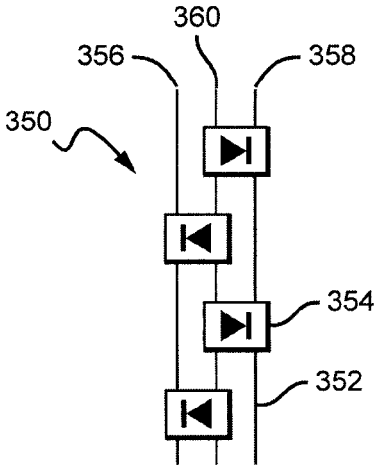
FIG. 6
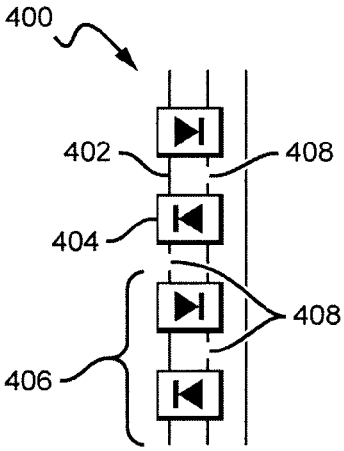
FIG. 7
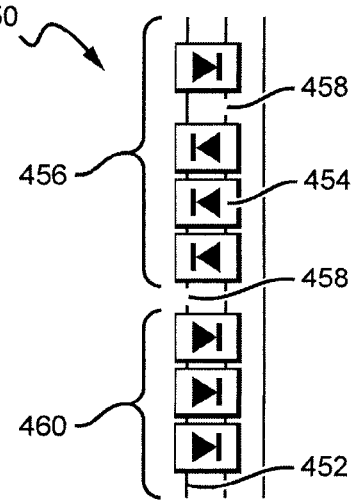
FIG. 8

FIG. 9
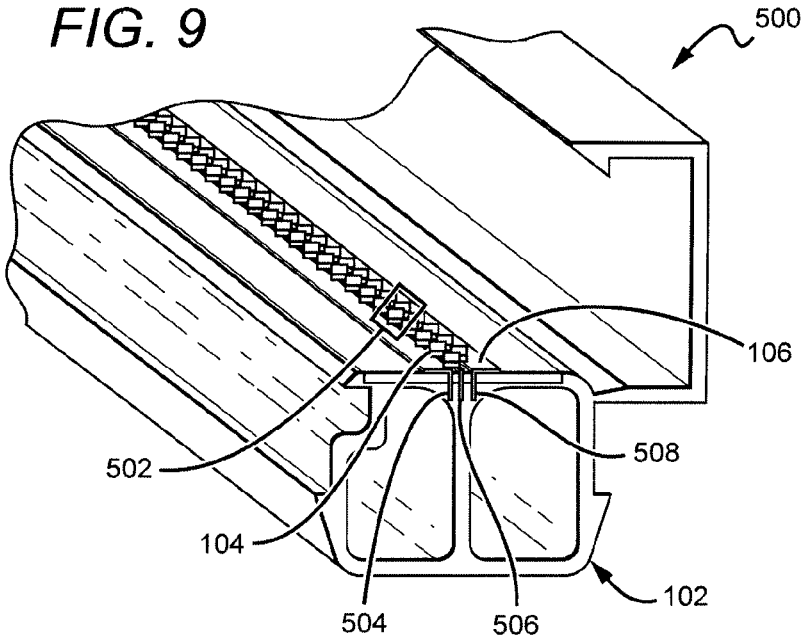
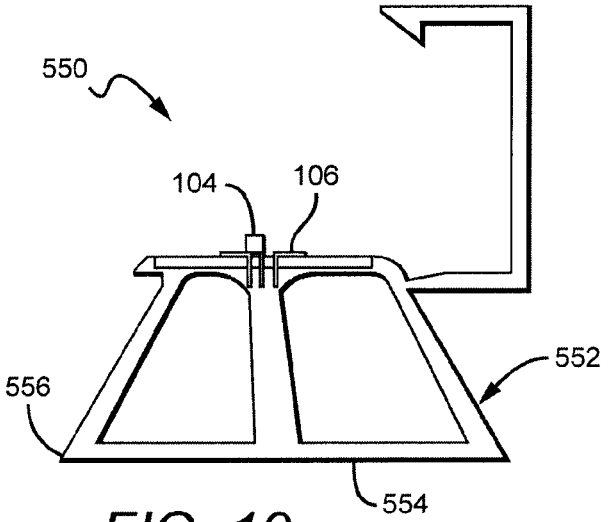
FIG. 10
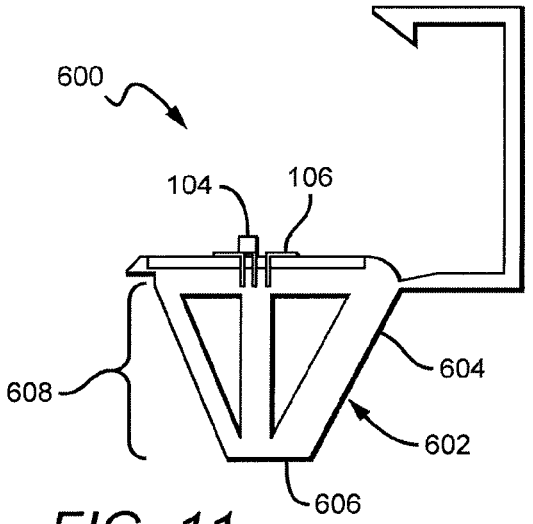
FIG. 11

FIG. 12
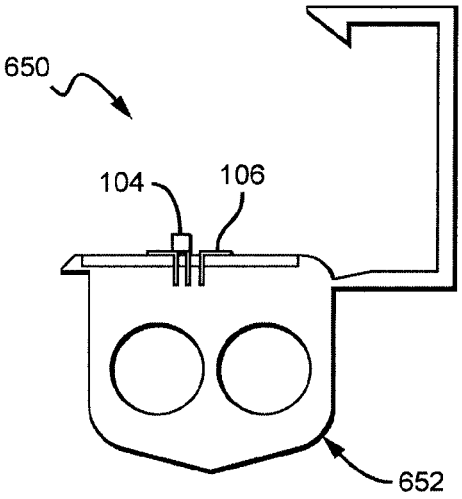
FIG. 13
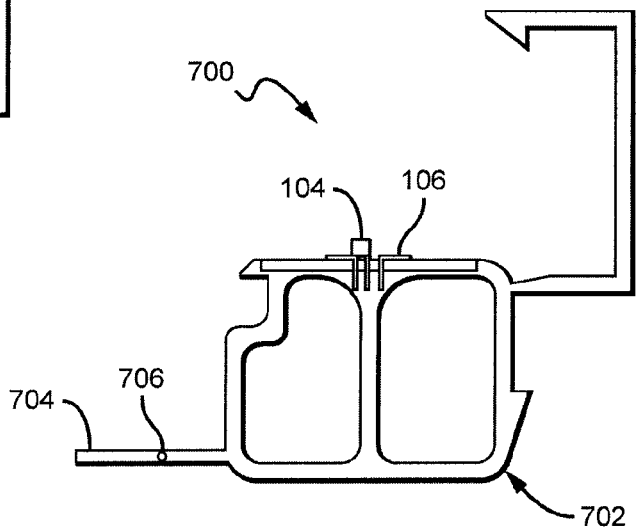
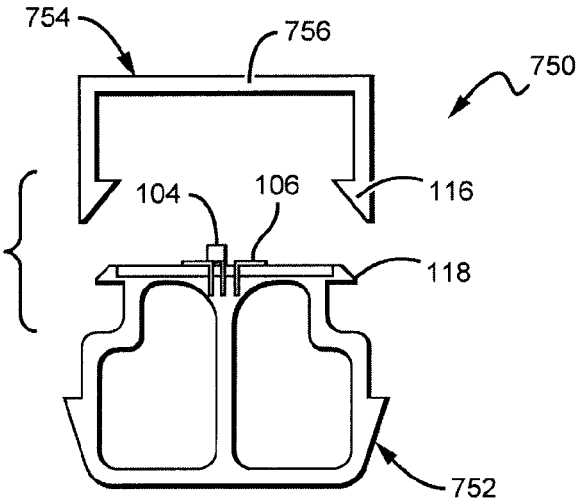
FIG. 14
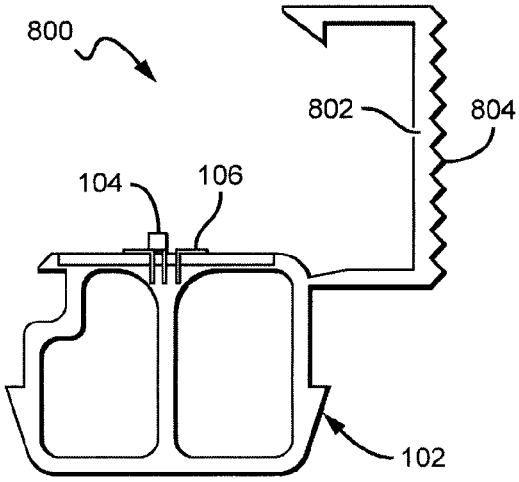
FIG. 15

FIG. 20
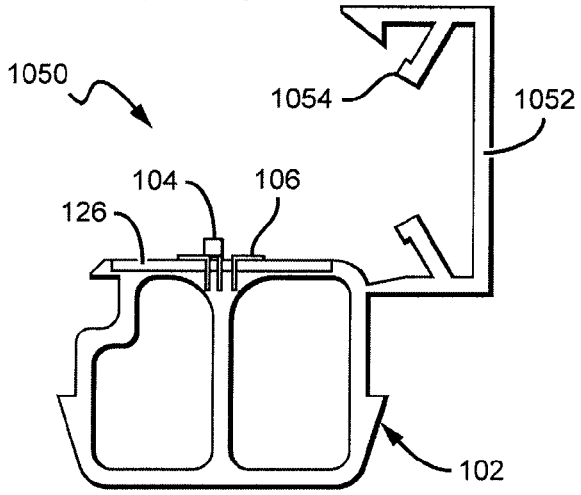
FIG. 21
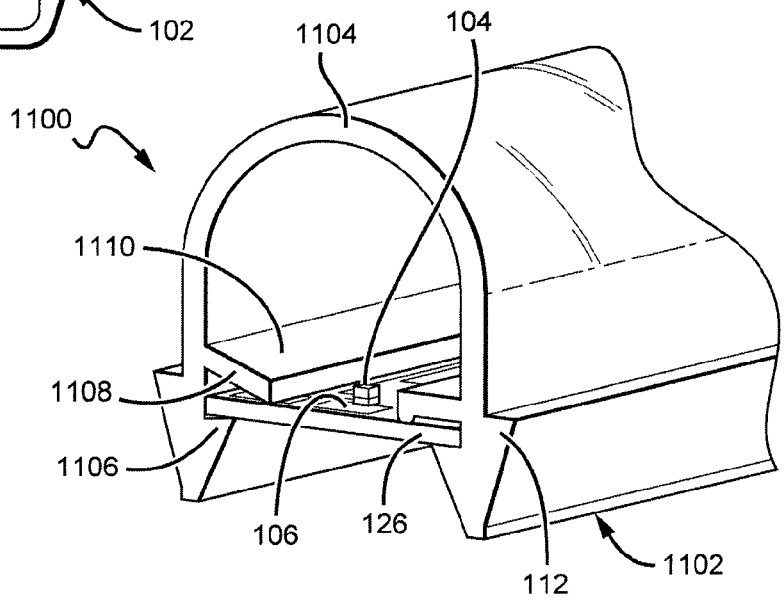
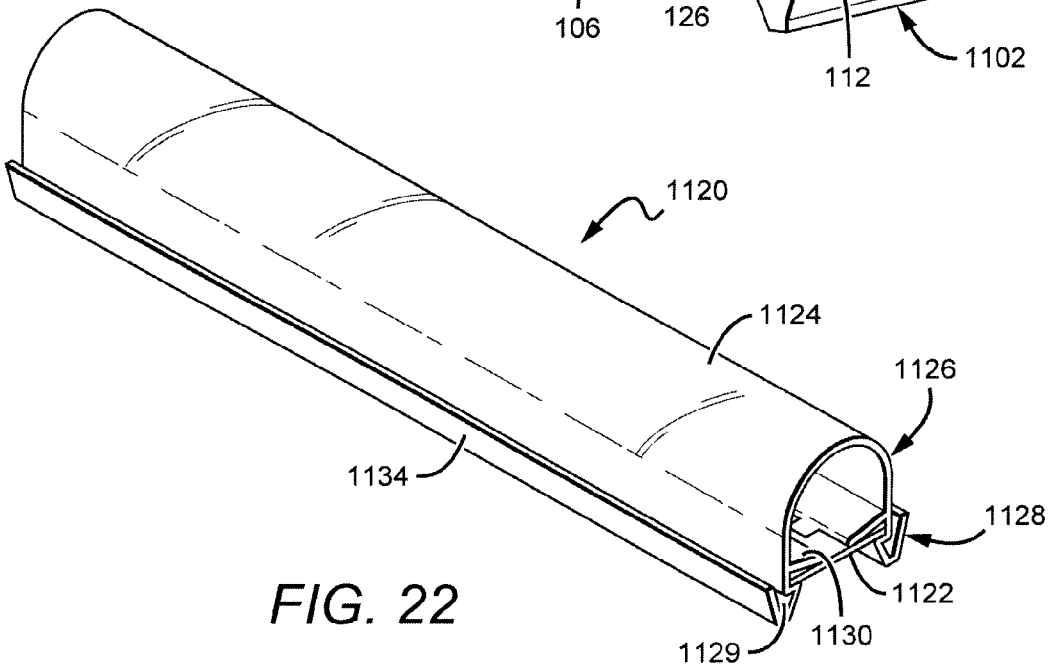
FIG. 22

FIG. 29
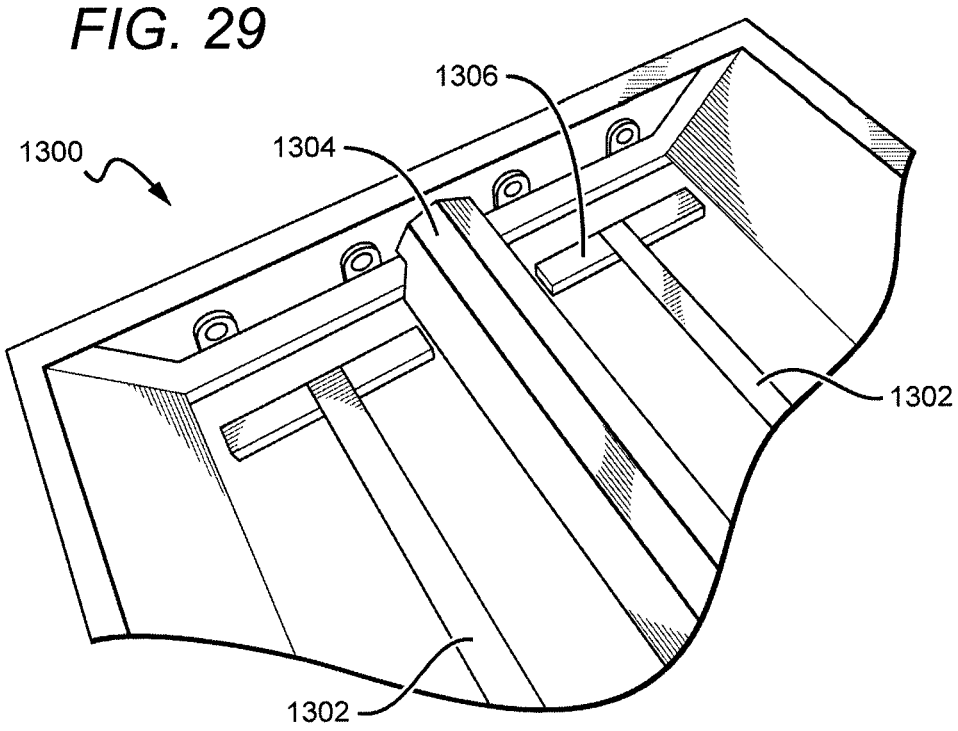
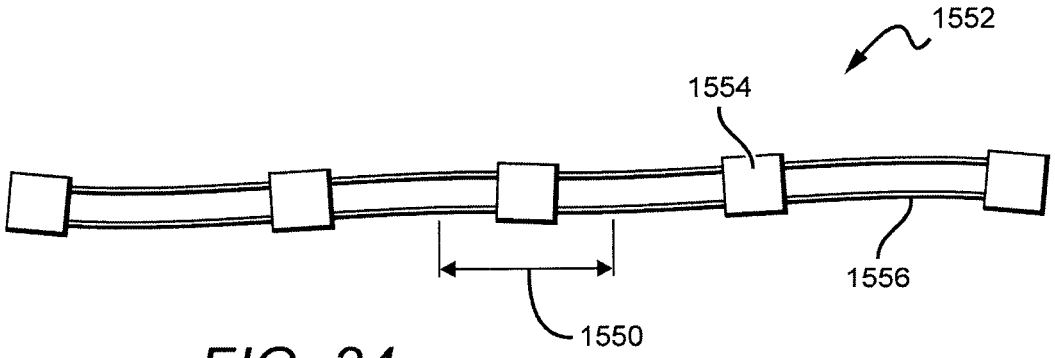
FIG. 34

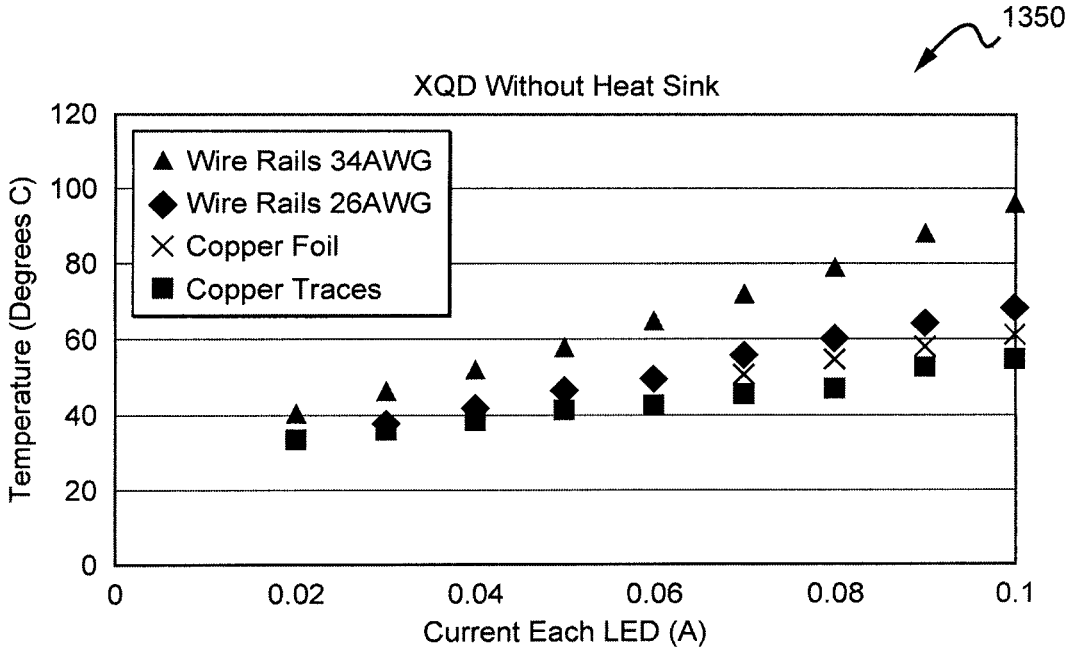
FIG. 30
FIG. 31
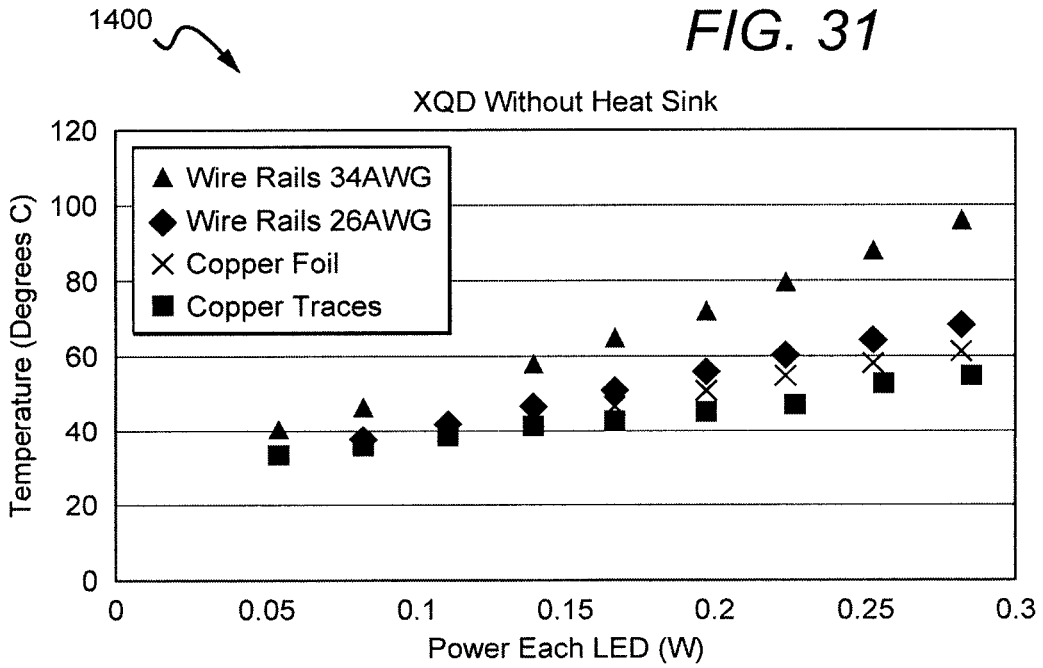

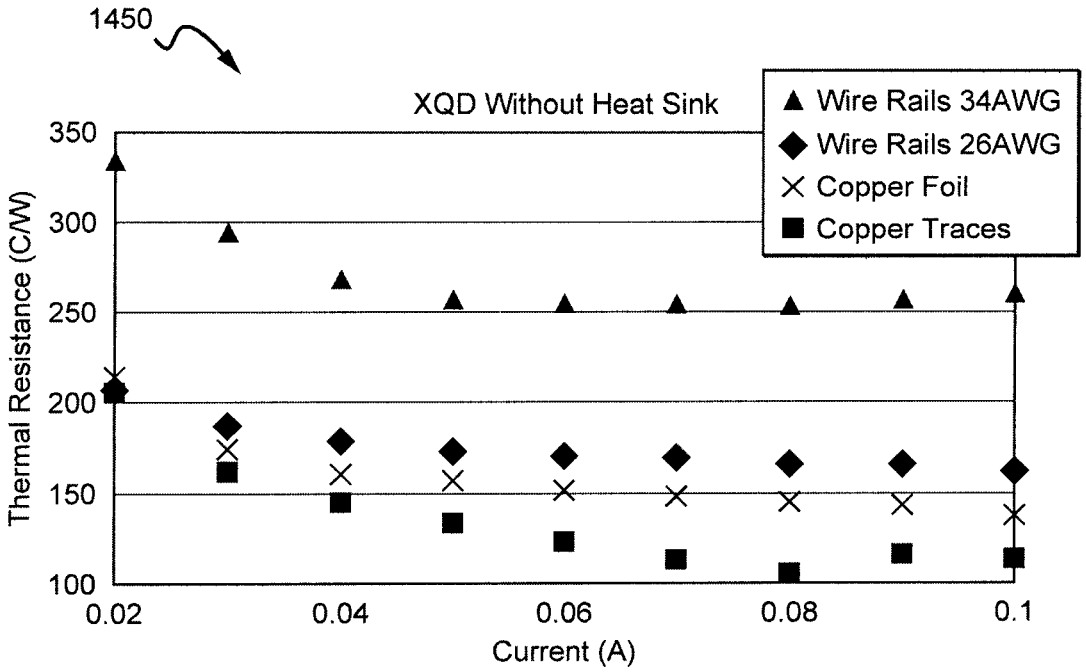
FIG. 32
FIG. 33
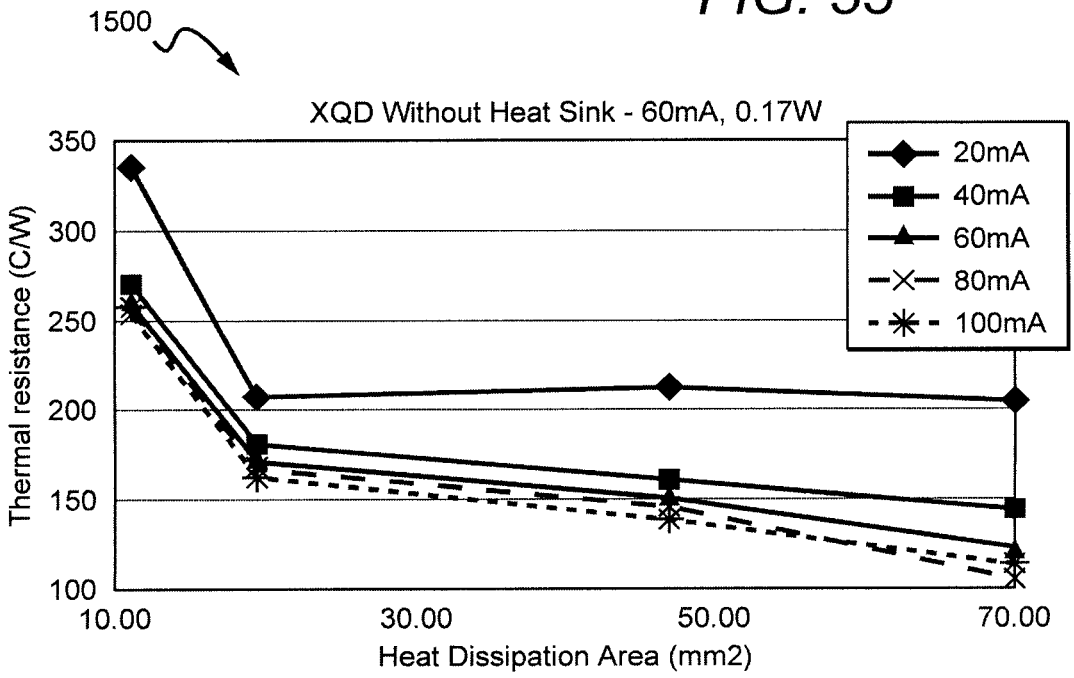

INTEGRATED LINEAR LIGHT ENGINE

CROSS REFERENCE TO RELATED APPLICATIONS

This application is a continuing application of, and claims the benefit of, U.S. patent application Ser. No. 13/782,820 to Mark Dixon et al., entitled Integrated Linear Light Fixture, which is a continuation in part of, and claims the benefit of, U.S. patent application Ser. No. 13/672,592 to Mark Dixon, entitled Recessed Light Fixture Retrofit Kit, which is hereby incorporated herein in its entirety by reference, including the drawings, charts, schematics, diagrams and related written description.

BACKGROUND OF THE INVENTION

1. Field of the Invention

Described herein is a device relating to light engines for use in lighting fixtures, such as troffer-style fixtures, that are well suited for use with solid state lighting sources, such as light emitting diodes (LEDs).

2. Description of the Related Art

Troffer-style fixtures are ubiquitous in commercial office and industrial spaces throughout the world. In many instances these troffers house elongated fluorescent light bulbs that span the length of the troffer. Troffers can be mounted to or suspended from ceilings, and can be at least partially recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, troffers have been developed that utilize LEDs as their light source. The LEDs can be arranged in different ways in the troffers, with some having LEDs arranged in a light engine. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications, such as troffers, that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Light engines that can be utilized in lighting fixtures, such as those mentioned above, typically comprise various components such as an array of multiple LED packages mounted to a printed circuit board (PCB), substrate or submount. The array of LED packages can comprise groups of LED packages emitting different colors, and specular or diffuse reflector systems to reflect light emitted by the LED chips. Some of these LED components are arranged to produce a white light combination of the light emitted by the different LED chips.

Modern lighting applications often demand high power LEDs for increased brightness. High power LEDs can draw large currents, generating significant amounts of heat that must be managed. In addition to the above mentioned components, many systems utilize heat sinks which must be in good thermal contact with the heat-generating light sources. Some previous LED based light engines would have inadequate thermal management means, resulting in unacceptable heating of the light engine and/or heat related failure of the light engine. For most current lighting applications, light engines utilize heat sinks to adequately dissipate heat from the light sources into the ambient. Troffer-style fixtures generally dissipate heat from the back side of the light engine or the fixture that extends into the plenum. This can present challenges as plenum space decreases in modern structures. In addition to thermal management, heat sinks often provide necessary structural stability for light engines.

As mentioned above, many light engines utilize components such as PCBs, heat sinks, reflective elements and lenses, which are part of the light engine and are formed separately from the light engine body. These separately formed components must be assembled and/or attached to the light engine body to form a complete light engine. As the number of desirable or required components that must be later assembled increases, the manufacturing and assembly processes become more complicated, costly and requires more materials. This can result in a light engine that is not only complex, but also expensive.

SUMMARY OF THE INVENTION

The present invention is generally directed to different embodiments of light engines comprising many improved features, such as integrated features that were previously formed separately and then assembled. The different embodiments according to the present invention can also comprise integral components various integral components such as a PCB, heat sink, lens, cover portion or reflector, or can otherwise simplify the integral feature incorporation of such components into the light engine. In still other embodiments, the improved features and integral nature of the light engine can result in the elimination of one or more of these previously necessary feature or elements. In one embodiment, the light engine comprises a body, light sources, and conductive elements integrated into the body. The conductive elements can be in communication with the light sources, with the conductive elements configured to define electrical pathways between said light sources.

One embodiment of a light engine according to the present disclosure comprises a rigid body, at least one light source on the body and at least one conductive element integrated into the rigid body and in communication with said light source, wherein the at least one conductive element configured to dissipate heat generated during operation of said light source.

Another embodiment of a light engine according to the present disclosure comprises a body, at least one conductive element on the body, at least one light source in communication with the at least one conductive element, and a lens integrated into the body.

Another embodiment of a light engine according to the present disclosure comprises a body, at least one conductive element on the body, at least one light source in communication with the at least one conductive element, and a reflective element integrated into the body.

Still another embodiment of a method for producing a light engine according to the present disclosure comprises coextruding a body, reflective element and lens, placing at least one conductive element in place during the extrusion process, and bonding at least one light source in communication with said at least one conductive element.

These and other further features and advantages of the invention would be apparent to those skilled in the art from the following detailed description, taking together with the accompanying drawings, wherein like numerals designate corresponding parts in the figures, in which:

BRIEF DESCRIPTION OF THE DRAWINGS

FIG. 3 is a top perspective view of one embodiment of a conductive foil configuration that can be utilized with the present disclosure;

FIG. 4 is a front perspective view of one embodiment of a conductive rail configuration that can be utilized with the present disclosure;

FIG. 5 is a top view of one embodiment of a conductive braided wire configuration that can be utilized with the present disclosure;

FIG. 6 is a schematic diagram depicting one embodiment of a circuit arrangement that can be utilized with the present disclosure;

FIG. 7 is a schematic diagram depicting another embodiment of a circuit arrangement that can be utilized with the present disclosure;

FIG. 8 is a schematic diagram depicting still another embodiment of a circuit arrangement that can be utilized with the present disclosure;

FIG. 9 is a front perspective view of one embodiment of a light engine according to the present disclosure;

FIG. 10 is a front sectional view of one embodiment of a light engine according to the present disclosure;

FIG. 11 is a front sectional view of one embodiment of a light engine according to the present disclosure;

FIG. 12 is a front sectional view of one embodiment of a light engine according to the present disclosure;

FIG. 13 is a front sectional view of one embodiment of a light engine according to the present disclosure;

FIG. 14 is a front sectional view of one embodiment of a light engine according to the present disclosure;

FIG. 15 is a front sectional view of one embodiment of a light engine according to the present disclosure;

FIG. 20 is a front sectional view of one embodiment of a light engine according to the present disclosure;

FIG. 21 is a front perspective view of one embodiment of a light engine according to the present disclosure;

FIG. 22 is an top perspective view of one embodiment of a light engine according to the present invention;

FIG. 29 is a perspective partial view of a troffer-style fixture assembly that can be utilized with the present disclosure;

FIG. 30 is a temperature profile graph comparing different embodiments of a light engine according to the present disclosure;

FIG. 31 is another temperature profile graph comparing different embodiments of a light engine according to the present disclosure;

FIG. 32 is a graph charting the relationship between thermal resistance and current in relation to different embodiments of a light engine according to the present disclosure;

FIG. 33 is a graph charting the relationship between thermal resistance and heat dissipation area in relation to different embodiments of a light engine according to the present disclosure; and FIG. 34 is top perspective view of an embodiment according to the present disclosure that depicts the heat dissipation area referenced in FIG. 33.

DETAILED DESCRIPTION OF THE INVENTION

Figure 1:
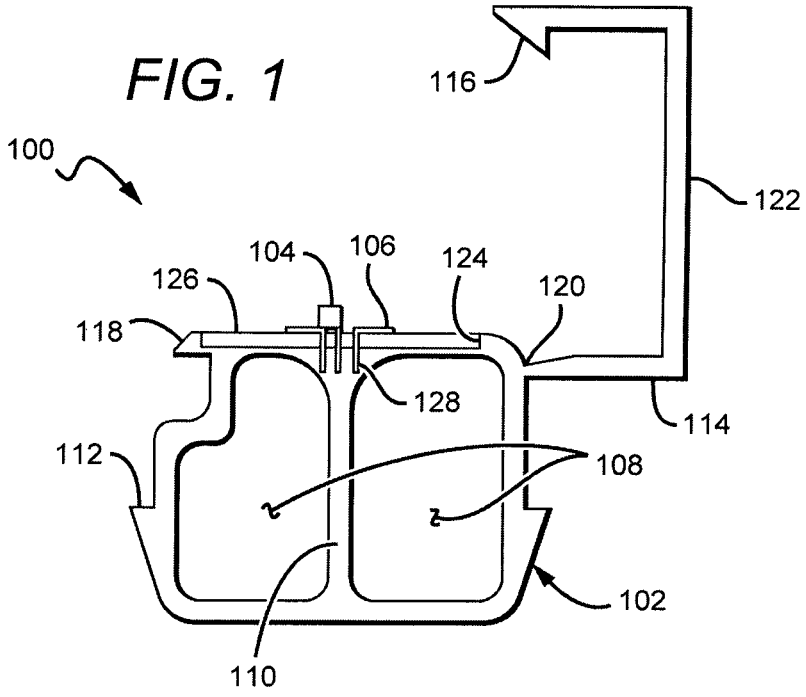
FIG. 1 is a front sectional view of one embodiment of a light engine according to the present disclosure.

The present disclosure is directed to different embodiments of light engines with integrated features that eliminate the need for one or more separately produced typical light engine components such as a PCB, heat sink, lens, cover portion or reflector. In some embodiments, the need for some of these separately formed components can be eliminated by forming integral structures. By reducing the number of necessary components, time and cost can be conserved, fewer materials can be used, and additional benefits can be attained as described below.

In some embodiments, the need for a PCB can be eliminated, for example, by utilizing conductive elements integrated into a light engine body. These conductive elements can be configured to define conductive pathways between light sources in a light engine. The conductive elements can provide several advantages over conventional PCBs. For example, many conductive elements embodiments, such as wire rails, have a considerably lower cost when compared to a PCB. The conductive elements according to the present invention also provide more freedom in the design of conductive pathways. For example, such conductive pathways can achieve longer lengths than most PCBs, as many conventional PCB boards are limited to about 24 inches; therefore, a fourfoot light engine section would require multiple boards and a connection between. Furthermore, conductive pathways designed from conductive elements according to the present disclosure can also enable three-dimensional circuit routing, which is not available from most conventional PCBs.

In other embodiments, the need for a separate heat sink structure can be eliminated, for example, by utilizing efficient light sources in conjunction with conductive elements configured to dissipate heat. In one such configuration the conductive elements and light sources circuit can be freely exposed to the ambient air, allowing for efficient heat dissipation. The conductive elements can also be configured with an increased surface area that increases the heat dissipation area of the conductive elements. This can further enhance heat dissipation through conduction or convection, as will be discussed further below. Efficient light sources can include, for example, light sources that have low operating electrical drive current requirements and/or light sources comprising additional heat dissipating features. As mentioned above, in many light engines, the heat sink provides the structural integrity for the light engine. Light engines according to the present disclosure can further comprise rigid bodies that eliminate the dependence on a heat sink for structural support.

In still other embodiments, the need for a separate formed reflective element can be eliminated, for example, by co-extruding a reflective surface along with the light engine body such that it is incorporated into the light engine body as an integral part. This co-extrusion process saves time, materials and cost associated with forming a separate reflective element that is then mounted to the light engine body. Co-extrusion can also provide for increased structural stability of the overall light engine body as a result of the elimination of the spatial interplay between the reflective element and the light engine body. This results in a more stable structure compared to light engines wherein a reflective element is attached through another means.

In still other embodiments, the need for a separate cover portion or lens structure can be eliminated, for example, by extruding a lens feature along with a light engine body such that it is incorporated into the light engine as an integral part. Extrusion can result in the lens being attached to the light engine's body, preferably by a mechanism that allows for the lens to open and close over the light engine's light sources. Many different opening/closing mechanisms can be used with some embodiments utilizing a living hinge. This allows the lens to have multiple positions, such as a position covering the light sources and a position allowing access to the light sources and conductive elements. This simplifies the manufacture of light engines according to the present disclosure as the lens, body and conductive elements can be formed integral to one another, for example, during an extrusion process. Light sources can then be installed onto the conductive elements, and the lens can then be moved into a position covering the light sources.

In addition to providing a simplified lighting engine or structure that can eliminate the need for certain components, devices according to the present disclosure provide embodiments that facilitate or simplify the mounting or incorporation of such elements into light fixtures such as troffers. For example, some embodiments according to the present disclosure can include various connecting portions and/or "snap-fit" structures that streamline the light fixture assembly process as will be discussed in detail further below.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present. It is also understood that when an element is referred to as being "connected" or "coupled" to another element, it can be directly connected or coupled to the other element or intervening elements may be present. In contrast, when an element is referred to as being "directly connect" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes" and/or "including when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions, illustrated herein but are to include deviations in shapes that result, for example, from manufacturing.

FIG. 1 is a front sectional view of one embodiment light engine 100 according to the present disclosure. Light engine 100 comprises a body 102, at least one light source 104, and one or more conductive elements 106. Body 102 can comprise a variety of materials, including but not limited to metals, plastics, various polymers and/or combinations thereof. In one embodiment, body 102 can be formed from polycarbonate (PC). Body 102 can be formed via a number of processes, including but not limited to extrusion and molding, such as injection molding.

Body 102 can be clear, transparent or translucent such that light emitted from light source 104 can easily pass through body 102. Body 102 can also be diffuse, and in different embodiments can be made diffuse by various means including but not limited to being formed from a diffuse material, being patterned or shaped to have diffuse portions, or by adding materials having diffusing properties, such as diffusing particles. Body 102 can comprise a rigid structure to provide structural support for light engine 100. This rigidity can be the result of many different factors, such as the material used for the body and/or the integrated nature of its body's component parts. In many conventional light engines, the rigidity and stability of the light engine's structure is provided by a heat sink. The rigidity of body 102, in combination with the properties and arrangement of highly efficient light sources 104 and conductive elements 106 (which will be discussed further below) eliminate the need for a heat sink structure. It is understood that the shape, dimensions and orientation of body 102 depicted in the drawings are but some of many shapes body 102 can comprise. Body 102 can comprise a variety of shapes, dimensions and orientations for various purposes, for example depending on the needs of various light fixtures where light engine 100 could be employed. Additional example embodiments of body 102 will be discussed further below.

Body 102 can further comprise at least one hollow portion 108 (two shown) and at least one support structure 110 (one shown). Hollow portions 108 can be shaped to define parallel longitudinal channels that run the entire length of body 102. Hollow portions 108 can be designed to accommodate wires, cords, cables or other electrical conductors (not shown) for providing power to light sources. In one embodiment, hollow portions 108 are approximately 1 inch wide, but it is understood that they can be larger or smaller. In embodiments with multiple hollow portions 108, these portions can be the same shape or can comprise different shapes, for example, as needed to accommodate different types of cords, wires, etc. While hollow portions 108 are shown as being entirely enclosed within body 102, portions of body 102 can be open or otherwise accessible. This arrangement provides outside access to hollow portions 108. It is understood that light engines according to the present disclosure can be formed without hollow portions 108, for example, by forming body 102 as a solid piece of material. It is also understood or that hollow portions 108 can be fully or partially filled with other materials.

Support structure 110 can be included to provide additional support to body 102 and compensate for any slight stability loss due to the formation of hollow portions 108. Support structure 110 can comprise any number of useful shapes and orientations depending on the needs and particular shapes and orientations of body 102. For example, in the embodiment shown in FIG. 1, support structure 110 comprises an I-beam type shape and runs the entire length of body 102. This configuration provides structural support, assisting in maintaining the shape of body 102 as well as providing support for additional features that can be placed on body 102. Support structure 110 can span the entire length of body 102 as describe above or can comprise multiple support structures formed at various locations in body 102. For example, support structure 110 can comprise multiple I-beams spaced down the length of body 102. Alternatively or in addition, support structure 102 can comprise multiple pluralities of support structures having different shapes or orientations.

Various connecting features can be utilized with light engines according to the present disclosure to allow the light engines to be installed into fixtures or be attached to additional lighting components. In the embodiment shown, body 102 can further comprise a connecting portion 112 that enables light engine 100 to interface with other structures for further device assembly. Connecting portion 112 can be shaped or configured to allow for mounting of light engine 100 to a lighting fixture, for example, for troffer retrofits. In one embodiment, connecting portion 112 comprises a "snap-fit" feature shaped or configured to interact and cooperate with a corresponding structure for attachments of light engine 100.

Devices according to the present disclosure can further comprise cover portions that provide protection to the covered components and can function as a lens as will be discussed further below. In light engine 100, cover 114 can be physically attached to or part of body 102 or can be a separate piece. Cover or lens 114 can be removed or displaced so that various components, such as light source 104 and conductive elements 106, can be easily installed on the upper portion of body 102. Cover 114 can be made of the same material as body 102 and can be formed separately from body 102, or integral with body 102. Different formation methods can be used such as an extrusion process where the cover is extruded with the body and integral to the body. Cover 114 can also be made of a different material from body 102 and co-extruded with body 102 to form both structures integral to one another. In some embodiments, both body 102 and cover 114 are clear, transparent or translucent, while in other embodiments both the body 102 and/or the cover 114 are diffuse. By utilizing a method that can form cover 114 simultaneously with and integral to body 102, for example an extrusion or injection molding process, the manufacturing process can be simplified and associated costs reduced. Additionally, by extruding cover 114 with body 102 such that it is integrated and essentially an extension of body 102, one need not manufacture an additional cover piece, thus reducing the amount of components in light engine 100.

The cover 114 can be attached to the remainder of the body by mechanisms that allows for opening and closing of a cover over the body. In some embodiments, cover 114 can be physically attached to body 102 at one or more positions by a living hinge 120. Living hinge 120 can be formed integral to cover 114 and body 102, for example, during an extrusion or injection molding process. Living hinge 120 comprises a thinned portion of the material body 102 and/or cover 114 that allows the rigid portions of body 102 and cover 114 to bend along point where living hinge 120 attaches the two structures together. When cover 114 is in its "open" configuration (as depicted in FIG. 1), cover 114 is not substantially enclosing elements on the top surface of the body 102, for example, light source 104 and conductive elements 106. When cover 114 is in its "closed" position, it is substantially enclosing elements on the surface of the body 102. The "closed" position of cover 114 can be further secured in embodiments where at least one portion of cover 114 comprises a cover-attachment portion 116 that can interact or mate with a corresponding body-attachment portion 118, as discussed above, thus holding or locking cover 114 in place.

Cover 114 can perform several functions including protection of enclosed elements on body 102 and serving as a lens for light emitted from light source 104. As mentioned above, cover 114 can be integral to body 102 via extrusion, simplifying the manufacturing process and reducing costs while allowing access to the top portion of body 102 for the installation of additional features, including light source 104 and conductive elements 106. Another advantage of integrating the cover 114 with body 102 is that the position of cover 114 need not be permanent but can be configured to have various positions, such as the "open" and "closed" positions as discussed above. This can allow a user to "toggle" between a closed protective cover with lens properties during operation of the device and open position that allows access to the top surface of body 102. Access can be needed in different circumstances, such as when the user accesses various elements of the device for purposes of replacement or repair of features on body 102.

The entirety of cover 114, or one or more dedicated surfaces, can serve as a lens 122 for directing, scattering, focusing, or altering the direction and nature of, emitted light. Since the entirety of cover 114 can function as a lens, it is understood that portions of this disclosure that refer to a lens can equally refer to a cover portion. Lens 122 can be clear, transparent or translucent, or can comprise additional structures and materials for altering the color of emitted light, with some embodiments comprising wavelength altering materials such as phosphors. In other embodiments, the lens 122 can comprise light scattering particles, and the lens 122 can be structured or patterned to increase light extraction.

Body 102 can further comprise a channel 124 on one of its surfaces or within body 102 itself. In one embodiment channel 124 is on the top surface of body 102. Channel 124 can be configured to receive other device components such as light source 104, conductive elements 106 or a reflective element 126. Channel 124 can be configured to receive a temporary carrier structure (not shown) which can hold and control the placement of conductive elements 106. The carrier structure can be pressed into channel 124 to position conductive elements 106 as desired; the carrier structure can then be removed. Such a carrier structure can comprise a flexible material, for example a paper or plastic adhesive structure such as tape. Conductive elements 106 can be arranged into pre-designed conductive pathways on the carrier structure to hold them in a fixed position. The conductive pathways can then be placed into channel 124 prior to the carrier structure being removed.

Light engines according to the present disclosure can further comprise one or more reflective elements to increase light extraction. As shown in FIG. 1, light engine 100 can further comprise reflective element 126, which can be made of various reflective materials that are known in the art. Reflective element 126 can be made from materials similar to body 102, such as plastics, polymers and PC, or can be made from different materials from body 102. In one embodiment, reflective element 126 comprises a reflective white area. The reflective white area can be on a portion of reflective element 126, or reflective element 106 can be entirely reflective white. Reflective element 126 can be formed separately from body 102 and mounted to the body. In one embodiment, body 102 can comprise an element configured to receive reflective element 126, for example, channel 124 discussed above. In one embodiment, reflective element 126 and channel 124 can be configured such that portions of each structure correspond to portions on the other structure, forming a "snap-fit". In one embodiment, reflective element 126 comprises a reflective film that is added to the top surface of body 102.

Reflective element 126 can also be co-extruded with body 102 and formed integral to said body. By forming reflective element 126 simultaneously as an integrated element of body 102, the manufacturing process is simplified, less additional separate components are produced and associated costs are reduced. Furthermore, by co-extruding reflective element 126 with body 102, there is less spatial interplay between the two structures, resulting in a more structurally stable device.

As mentioned above, in conventional light engines, the heat sink provides the structural support for the light engine. In different embodiments according to the present disclosure the heat sink can be eliminated, and body 102 can be rigid to provide the structural support normally provided by a separate heat sink. One way to increase the rigidity of the structure is through an extrusion process. In embodiments wherein reflective element 126 and/or cover 114 can be coextruded with body 102, the resulting light engine structure has a greater structural integrity than embodiments wherein the other elements, such as reflective element 126, can be added separately, being attached to body 102 later by another means. The coextrusion process allows for situations where body 102 can be made from clear PC and reflective element 126 can be made from highly reflective white material, yet both structures are coextruded together such that they are essentially one structure. This allows the resulting light engine to be more structurally stable, further eliminating the need for structural support provided by a separate heat sink structure.

Light source 104 can comprise any suitable light source, however the present disclosure is particularly adapted for solid state light sources such as LEDs. Light source 104 can also comprise highly efficient LED packages that are capable of operating at lower drive signals than many conventionally used LEDs. Since the current needed to drive such highly efficient LEDs can be lower, the power in each LED can also be lower. Multiple LEDs can be used to achieve the same output as fewer LEDs with a higher current. By using more LEDs the necessary heat dissipation area can be smaller. The heat dissipation area of conductive elements will be discussed in more detail further below. These highly efficient LED packages can further comprise additional heat dissipating features. Examples of such highly efficient LEDs are described in detail in U.S. patent application Ser. Nos. 13/649,052 and 13/649,067, both also assigned to Cree, Inc., which are hereby incorporated herein in their entirety by reference, including the drawings, charts, schematics, diagrams and related written description.

One way in which highly efficient LEDs can operate at lower drive signals than convention LEDs is that the highly efficient LED packages have a greater LED area per package footprint, which can allow for higher packing density. In many applications, this allows for driving the same area of LED packages with a lower drive signal to achieve the same emission intensity. This can result in greater emission efficiency. In other embodiments, the same drive current can be used, and the LED packages that can be utilized with the present invention can be used to generate higher emission intensity. These embodiments provide the flexibility of providing LED package emission with high luminous flux, or with lower luminous flux at greater efficiency.

The different highly efficient LED package embodiments can operate from different drive signals, with some operating from signals from 50 mWatts to several tens of Watts. In some embodiments, the drive signal can be in the range of 500 mWatts to approximately 2 Watts. The different embodiments can also provide different luminous flux output, with some embodiments emitting 100 lumens or more. Other embodiments can emit 110 lumens or more, while other embodiments can emit 150 lumens or more. Different embodiments can also emit different color temperatures in the range of 2000 to 6000K, with some embodiments emitting approximately 3000K and others approximately 5000K. By way of example, an LED package that can be utilized with the present invention having a package footprint of 1.6 by 1.6 mm, can emit approximately 120 lumens at a temperature of 3000K. Other embodiments having the same size can emit 140 lumens at 5000K. The area for the package footprint is 2.56 $mm^2$ resulting in emission of 47 lumens/$mm^2$ at 3000K, and 55 lumens/

$mm^2$ at 5000K. As LED technology increases and highly efficient LEDs begin to operate at even lower drive signals, these lower drive signals can be utilized with devices according to the present disclosure.

Different packages that can be utilized with the present invention can generally emit in the range of 35 to 65 lumens/$mm^2$. Packages that are approximately 1.6 mm tall can have a volume of approximately 4.096 $mm^3$, resulting in operation at approximately 29.27 lumens/$mm^3$ at 3000K and 34.18 lumens/$mm^3$ at 5000K. Different packages that can be utilized with the present invention can generally emit in the range of 20 to 45 lumens/$mm^3$. This can vary depending on the drive signal (or drive current) but does, however, result in a operation of 115 lumens per Watt (LPW) at 3000K, and 135LPW at 5000K. Other embodiments having different drive signals can also exhibit similar LPW operation at the same color temperature. The range of LPW for the different embodiments can generally be in the range of 100 to 150 LPW.

As discussed in detail in the above incorporated references, these highly efficient LED packages can further comprise additional heat dissipating features. One example of such heat dissipating features are attach pads that can extend beyond the edge of the LEDs to cover most of the top surface of the package area. This can help in thermal management for the LED package by spreading heat from the LEDs into the pads so that heat spreads beyond the edge of the LEDs into more area of the package. This allows the heat to be less localized and allows it to more efficiently dissipate through a submount into the ambient.

A further example of heat dissipating features that can be incorporated into highly efficient LED packages is a conversion material layer that can also act as a remote layer with good thermal spreading. That is, heat generated during the conversion process, or heat from the LED that passes into the conversion material layer can be spread across the conversion material layer. The heat can then conduct into a submount and an encapsulant to dissipate into the surrounding ambient.

As discussed above, these highly efficient LED packages are particularly suited at thermal management. These LED packages can efficiently operate at lower drive signals and consume less power per unit when compared to conventional LEDs, resulting in less heat generated. Furthermore, as set forth above and in the incorporated references, these packages can comprise additional heat dissipating features. When utilizing these highly efficient LED packages, conductive element embodiments, as discussed further below, can be sufficient to function as a heat dissipation element and eliminate the need for a separate heat sink. The minimal surface area of the conductive elements can be sufficient to dissipate the heat generated by said light source, for example, through conduction or convection. Utilizing these highly efficient LEDs also allows for closer light source spacing in light engines.

While highly efficient LEDs are discussed above, it is understood that other light sources with heat dissipating features and/or the ability to operate at lower drive currents and consume less power could be used in conjunction with conductive elements 106 and rigid body 102 to eliminate both the heat dissipation and structural needs of a heat sink.

Light sources 104, such as LEDs or LED packages, can be attached to conductive elements 106 in a variety of ways. For example, LEDs can be attached to conductive elements 106 using a conductive adhesive. An advantage of using conductive adhesive is that it does not require heating conductive elements 106 or body 102 to levels which can result in structure failure. Many different conductive adhesives can be used, for example Circalok™ 6972 and 6968 manufactured by Lord Corporation. Circalok™ 6968 has the advantage of having a cure time/temperature of approximately 1 hr/65° C., which is much less than that of solder reflow temperatures (which is potentially over 250° C.). When LEDs are bound to conductive elements 106 via a conductive adhesive, it is possible that the connection can be brittle and susceptible to bending or spatial displacement of the top portion of body 102. It may be necessary to adjust the flexion properties when designing body 102 in certain embodiments having pluralities of LEDs or conductive elements which are sensitive to structure flexing. The properties of the adhesive can also be adjusted to account for thermal expansion.

Additional methods of LED attachment can include: the use of low-temperature solder, which can be utilized with laser heating which will not significantly disturb underlying structures; the use of solder with induction heating for the purpose of providing a fast and local bond; and the use of sonic/vibration welding. Additionally, in certain embodiments, including wherein conductive elements 106 comprise flex circuits, traditional soldering can be used as described further below.

Conductive elements 106 can span the length of light engine 100, providing electrical connection to an outside power source and providing light sources 104 with internal electrical connections. The conductive elements can be a separate component such as a PCB or can be integrated into body 102 or reflective element 126. Conductive elements 106 can conduct electricity and/or heat and can be arranged in specific pathway configurations to direct electric current and/or heat in a desired manner thus eliminating the need for a PCB as discussed in greater detail below. Conductive elements 106 can be made of any suitable metal or other conductive material, and conductive elements 106 can also comprise materials with both conductive and nonconductive portions. In one embodiment, conductive elements 106 are made of copper. In one embodiment, conductive elements 106 comprise pad printed conductive traces. In one embodiment, the conductive elements can comprise wire of different gauges, such as 18-gauge wire, although many other gauges can be used. In other embodiments, conductive elements 106 comprise 26 and/or 34 American Wire Gauge (AWG) conductive wire rails. Conductive elements 106 can comprise a variety of shapes and structures. In the embodiment shown in FIG. 1, conductive wire rails are used.

In other embodiments, conductive elements 106 can comprise barbed portions 128 that can assist in the positioning and securing of conductive elements 106. For example, after a co-extrusion process in which body 102 and reflective element 126 are formed integral, conductive elements 106 can be easily integrated into the device by being pressed into the top surface of body 102 such that barbed portions 128 penetrate the top surface of body 102 and anchor conductive portions 106 to the top surface. Conductive elements 106 can be added after formation of body 102 and/or reflective element 126 or can be added simultaneously during their formation, for example, during the co-extrusion process. Alternatively, in embodiments wherein reflective element 126 is formed separately from body 102, conductive elements 106 can be embedded in reflective element 126, which can then be placed into the proper position as described above, for example, via a "snap-fit" method as discussed above.

Figure 2:
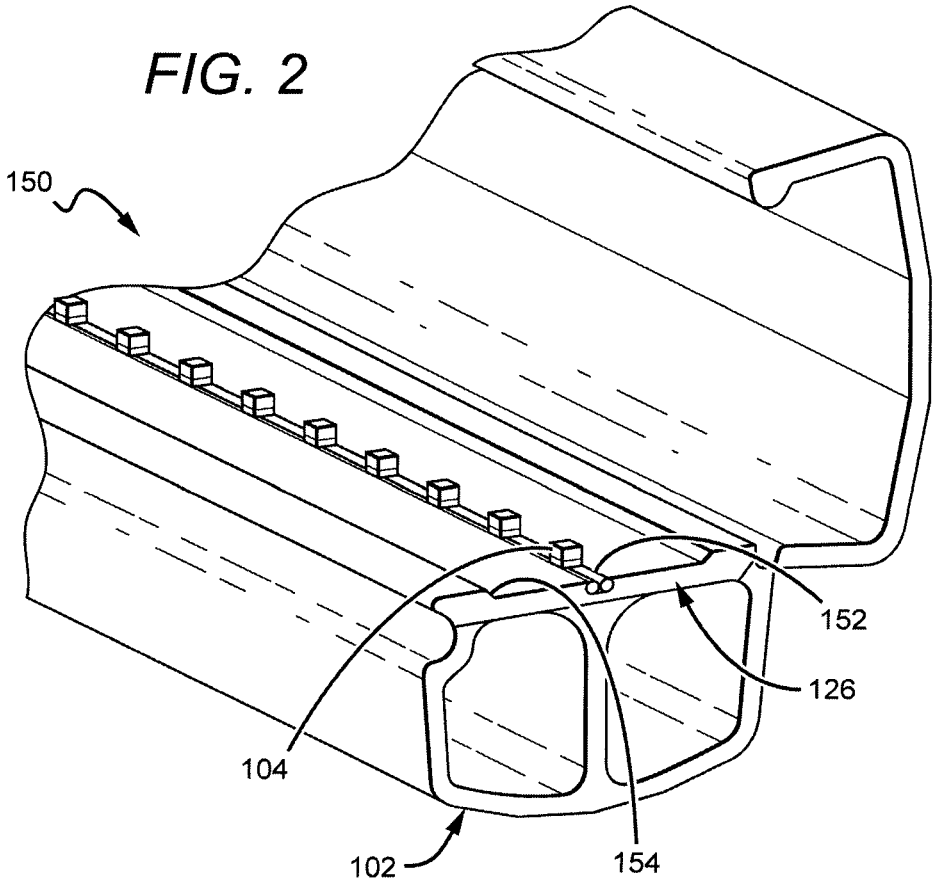
FIG. 2 is a front perspective view of one embodiment of a light engine according to the present disclosure.

Conductive elements 106 can also comprise magnet wire. FIG. 2 depicts a light engine 150, similar to light engine 100, wherein the corresponding disclosure above is incorporated into this embodiment such that like features share the same reference numbers. Light engine 150 comprises body 102, light sources 104, reflective element 126 and magnet wire rails 152 (used as conductive elements 106). FIG. 2 shows light sources 104 arranged in a non-staggered linear manner. Magnet wire rails 152 are typically coated with a thin insulation, for example, with enamel. In embodiments utilizing magnet wire, instances of electrical arcing between adjacent conductive elements are eliminated.

FIG. 2 also depicts an embodiment wherein reflective element 126 comprises sloped portions 154. These portions can increase light extraction from light engine 150, functioning similar to a reflector cup in a standard LED device. Sloped portions 154 can reflect rays of light emitted by light sources 104 which are emitted in a parallel direction to the base portion of reflective element 126.

Different light engines according to the present invention can have different conductive elements. FIG. 3 shows another conductive element embodiment which depicts conductive foil configuration 200. The conductive elements comprise light sources 202 and a conductive foil 204, which can be transferred to the body with an adhesive or via a screen printing transfer method. Using an adhesive has the advantage of not requiring numerous steps as the screen print transfer method may require. In one embodiment conductive foil 204 comprises a copper foil. Alternatively or in addition to conductive foil 204, the conductive elements can comprise a flex circuit on a flexible film, for example, on a polyamide film. Flex circuits have the advantage that light sources can be soldered to flex circuits without significantly damaging the circuit.

Referring now to FIG. 4, other embodiments of conductive elements can comprise a rail configuration 250, which comprises at least one non-conductive rail 252 which is selectively coated or plated with a conductive material, forming conductive regions 254 and non-conductive regions 256. An adjacent rail can be staggered by one-half (as shown), resulting in selectively interrupted electrical pathways that can be formed without the need for physically cutting or otherwise forming breaks in non-conductive rail 252. Light sources can then be bonded to rail configuration 250 utilizing the selectively interrupted conductive paths, thus forming conductive pathways between light sources. Such pathways can be, for example, parallel connections, series connections or combinations thereof, as discussed in more detail below. It is understood that while depicted in FIG. 4 as a square rail, nonconductive rail 252 can be a number of different shapes or indeed not even a rail, but another conductive element comprising a primarily non-conductive material that has been selectively coated or plated with a conductive material.

As shown in FIG. 5, the conductive elements can comprise flattened braided wire 300. Standard braided wire typically comprises several strands of wire looped together and surrounded by an insulating jacket. The insulating jacket can be selectively removed forming exposed wire portions 302. One method of removing select portions of the insulating jacket is via laser removal. Exposed wire portions 302 correspond to areas where light sources 304 will be placed in communication with exposed wire portions 302. This allows for formation of electrical pathways while preventing the insulator-jacket coated portions 306 from distributing excess electricity and heat to additional portions of the braided wire or other components on the surface of the body.

Devices according to the present disclosure can operate according to various power supply methods with the most common being low voltage (at ~60 volts and below) and high voltage (at ~200 volts and above). When devices according to the present disclosure are operated at high voltage, they run more efficiently resulting in reduction of operating costs; however, there may be instances, such as when it is necessary to conform to particular government regulatory standards, when it would be desirable to run the devices at low voltage.

FIG. 6 shows a circuit schematic diagram depicting a circuit configuration 350 comprising 2 parallel paths, wherein the conductive pathways 352 correspond to conductive elements 106 in FIG. 1 and the LEDs 354 correspond to light sources 104 in FIG. 1. Circuit configuration 350 corresponds to a low voltage operating power supply resulting in a 3 volt drop between the center rail and 2 outside rails through LEDs 354. Many different electrical pathways can be formed. For example, current can flow through first and second conductive pathways 356, 358 providing LEDs 354 with power. The LEDs may further be connected to a ground 360 which can allow for embodiments in which LEDs are staggered or offset from one another. These offset embodiments provide for further heat management due a lower concentration of LEDs in the same area, resulting in less heat production in the area.

FIG. 7 shows a circuit schematic diagram depicting a circuit configuration 400 comprising a series path, wherein the conductive pathways 402 correspond to conductive elements 106 in FIG. 1 and the LEDs 404 correspond to light sources 104 in FIG. 1. Circuit configuration 400 corresponds to a high voltage operating power supply. The conductive paths 402 comprise continuous portions 406 and interrupted portions 408.

Interrupted portions 408 above can be formed in various ways. In many embodiments, including embodiments wherein the conductive elements comprise wire or conductive rails, one of the more economical and efficient ways to form interrupted portions 408 is by cutting and/or removing portions of the conductive elements. This can be done after the conductive elements have been installed into a device to further simply the manufacturing process, reducing necessary time and cost. One method for cutting the selected portions of the conductive elements is via laser cutting or punch. The patterns of conductive and nonconductive areas can also be formed prior to being installed into a device by utilizing a nonconductive rail that has been which is selectively coated or plated with a conductive material as discussed above. Likewise, it is also possible to utilize a conductive element that has been selectively treated or coated with a material that interrupts electrical conductivity at selected portions. By altering the electrical pathways, the conductive elements can be configured to direct electricity in a desired manner, thus eliminating the need for a PCB.

It is understood that various other circuit configurations can be used depending on the operation needs of a particular device. These circuits can comprise parallel paths, series paths or combinations thereof. FIG. 8 shows a circuit schematic diagram depicting a circuit configuration 450 comprising a combination series-parallel path, wherein the conductive pathways 452 correspond to conductive elements 106 in FIG. 1 and the LEDs 454 correspond to light sources 104 in FIG. 1. Like in FIG. 7 above, the conductive paths 452 comprise continuous portions 456 and interrupted portions 458. In some embodiments, individual LEDs 454 can be connected in parallel forming LED groups 460. Individual LED groups 460 can further be connected in series. In the embodiment shown, three LEDs 454 are connected in parallel forming LED group 460. Between LED groups, the conductive pathways 452 can be interrupted as shown such that individual LED groups 460 are connected in series. In one embodiment, continuous portions 456 comprise a conductive element having a length of approximately 100 millimeters and interrupted portions comprise a "gap" of approximately 10 millimeters, with this pattern repeating down the length of the conductive pathway.

Light sources can be arranged in relation to the conductive elements to further prevent overheating. FIG. 9 depicts a light engine 500, similar to light engine 100, wherein the corresponding disclosure above is incorporated into this embodiment such that like features share the same reference numbers. Light engine 500 comprises body 102, light sources 104, and conductive elements 106. The arrangement of light sources 104 corresponds to the conductive pathway arrangement depicted in FIG. 6. Light sources 104 can be staggered along the length of body 102 to avoid concentrating heat produced by light sources 104 in the same location. While further increasing thermal management, the staggering of LEDs is not strictly necessary to eliminate the need for a heat sink structure, particularly in embodiments utilizing highly efficient LEDs as discussed above; LEDs may be lined up in a row or other arrangements are possible.

Groups of staggered light sources 502 can be further arranged to increase thermal management by arranging individual light sources 104 in each staggered group 502 such that each individual light source 104 in each staggered group 502 is in communication with at least one different conductive element from the others in the group. For example, where each staggered group 502 comprises two individual light sources, the first light source can be in communication with a first uncommon conductive element 504 and a common conductive element 506, whereas the second light source can be in communication with common conductive element 506 (along with first light source) and with second uncommon conductive element 508. This arrangement reduces the amount of heat concentrated on a particular conductive element 106 and further mitigates the need for a heat sink.

As mentioned above, the body can comprise many different shapes and orientations. FIG. 10 depicts a light engine 550, similar to light engine 100, wherein the corresponding disclosure above is incorporated into this embodiment such that like features share the same reference numbers. Light engine 550 comprises body 552, light sources 104 and conductive elements 106. Body 552 can have a trapezoidal shape. The shape of body 552 can provide a shape that allows for multiple arrangements in relation to a light fixture. For example, this trapezoidal shape can provide a flat base portion 554 which can rest on top of another structure. Alternatively or in addition, the angled base portions 556 can be arranged to catch on other objects, holding light engine 550 in place.

The body can comprise many different additional shapes. FIG. 11 depicts a light engine 600, similar to light engine 100, wherein the corresponding disclosure above is incorporated into this embodiment such that like features share the same reference numbers. Light engine 600 comprises body 602, light sources 104 and conductive elements 106. Body 602 can comprise a tapered angular shape, wherein body sidewalls 604 slope inward and terminate in an inverted plateau region 606. This body shape can correspond to another structure in which to mount light engine 600 to, such that the lower portion 608 of body 602 "plugs in" or mates with a corresponding portion of the mount structure. This can result in improved device aesthetics as a large portion of body 602 can be hidden from view. While it is understood that other embodiments can provide this advantage, body shapes such as the one of body 602 are configured to have less body surface area that must be concealed from view.

Yet another shape the body can comprise is shown in FIG. 12. FIG. 12 depicts a light engine 650, similar to light engine 100, wherein the corresponding disclosure above is incorporated into this embodiment such that like features share the same reference numbers. Light engine 650 comprises body 652, light sources 104, and conductive elements 106. Body 652 can have a rounded or hemispherical structure. Body 652 can also comprise an elliptical or conical structure. It is understood that although specific shapes and configurations of body embodiments are discussed above, these are only possible embodiments and the body can comprise a wide variety of other shapes.

The body can comprise many different additional structures, to assist in device assembly and/or to assist in the installation of the light engine into lighting fixtures. For example, the body can comprise a "winged" or "tabbed" structure comprising an extended portion that can be attached to other components or devices, such as lighting fixtures. These structures can be formed alternatively or in addition to connecting portions 112 referenced in FIG. 1 above. FIG. 13 depicts a light engine 700, similar to light engine 100, wherein the corresponding disclosure above is incorporated into this embodiment such that like features share the same reference numbers. Light engine 700 comprises body 702, light sources 104 and conductive elements 106. Body 702 further comprises extended portion 704 of body 702 that can comprise one or more holes 706 in which a fastening element such as a screw can attach extended portion 704 to another object, for example a troffer fixture.

FIG. 14 depicts a light engine 750, similar to light engine 100, wherein the corresponding disclosure above is incorporated into this embodiment such that like features share the same reference numbers. Light engine 750 comprises body 752, light sources 104, conductive elements 106 and cover 754 (which can comprise a lens 756). Cover 754 can comprise a "snap-fit" assembly, wherein one or more cover-attachment portions 116 (two shown) of cover 754 is shaped or configured to interact or mate with corresponding body-attachment portions 118 (two shown) of body 752. Cover 754 can comprise multiple cover-attachment portions 116 that interact or mate with multiple corresponding body-attachment portions 118. This allows cover 754 to securely snap onto body 752 or be removed as necessary, for example, when cover 754 is designed as a separate piece from body 752.

Alternatively or in addition to the "snap-fit" structure discussed above, one or more of cover-attachment portions 116 can be designed to permanently attach to body 752. For example permanently attaching the entirety of cover 754 to body 752 or permanently attaching one portion of cover 754 to body 752 such that the permanently attached portion functions as a pivot or hinge while other cover-attachment portions 116 can be attached or unattached as necessary. It is understood that different mechanisms of attachment can be used without deviating from the spirit of this disclosure.

As mentioned above, the lens can comprise many different shapes and is not limited to a square/rectangular shape or a smooth texture. FIG. 15, depicts a light engine 800, similar to light engine 100, wherein the corresponding disclosure above is incorporated into this embodiment such that like features share the same reference numbers. Light engine 800 comprises body 102, light sources 104, conductive elements 106 and lens 802. Lens 802 can comprise a roughened surface 804. Roughened surface 804 can create a uniform appearance from light engine 800 by randomizing the angle in which rays of light emitted from light source 104 hit the surface of lens 802, thus reducing instances of total internal reflection. Roughened surface 804 can be formed simultaneously with lens 802, for example through extrusion or injection molding, or can be formed after lens 802, for example through patterning, machining, grinding or etching.

Figure 16:
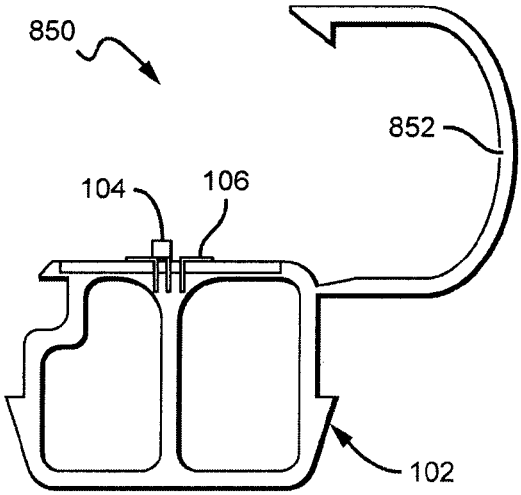
FIG. 16 is a front sectional view of one embodiment of a light engine according to the present disclosure.

The lens can comprise many different shapes. FIG. 16 depicts a light engine 850, similar to light engine 100, wherein the corresponding disclosure above is incorporated into this embodiment such that like features share the same reference numbers. Light engine 850 comprises body 102, light sources 104, conductive elements 106 and lens 852. Lens 852 can comprise a rounded surface, for example, lens 852 can be domed, spherical or elliptical and its shape can be selected for many reasons including spacing, aesthetic or light emission pattern reasons.

Figure 17:
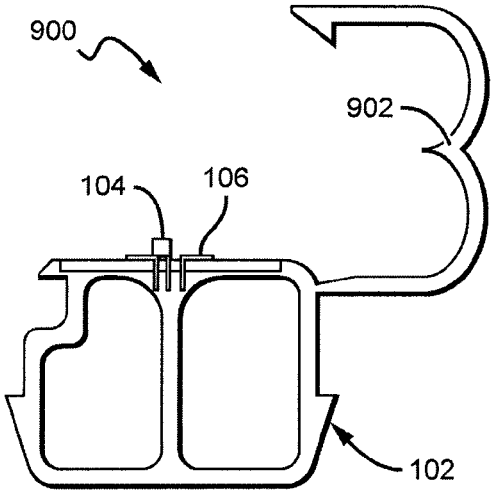
FIG. 17 is a front sectional view of one embodiment of a light engine according to the present disclosure.

FIG. 17 depicts a light engine 900, similar to light engine 100, wherein the corresponding disclosure above is incorporated into this embodiment such that like features share the same reference numbers. Light engine 900 comprises body 102, light sources 104, conductive elements 106 and lens 902. Lens 902 can comprise multiple instances of a domed, spherical or elliptical shape (two shown). In this embodiment, lens 902 can be configured to produce a "batwing" emission pattern.

Figure 18:
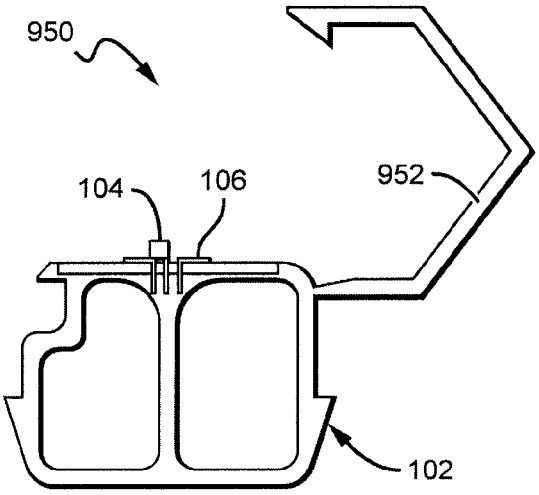
FIG. 18 is a front sectional view of one embodiment of a light engine according to the present disclosure.
Figure 19:
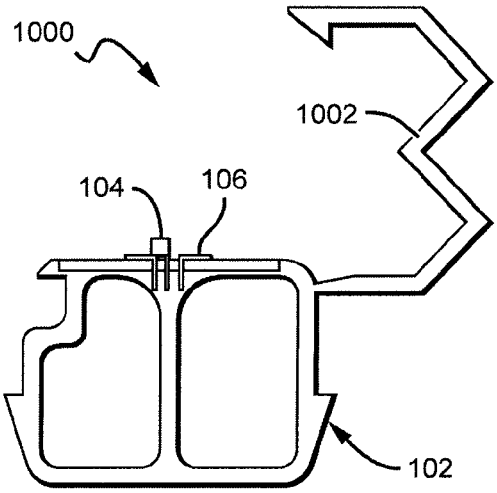
FIG. 19 is a front sectional view of one embodiment of a light engine according to the present disclosure.
Figure 23:
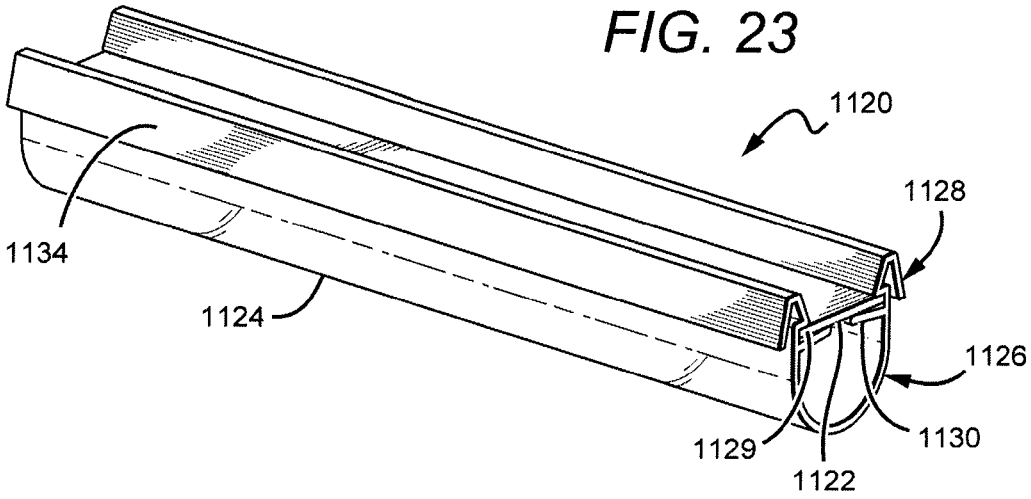
FIG. 23 is a bottom perspective view of the light engine shown in FIG. 22.
Figure 24:
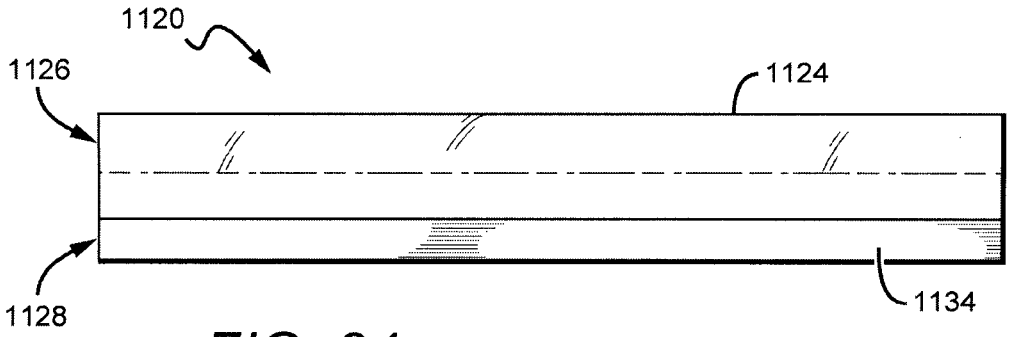
FIG. 24 is a side view of the light engine shown in FIG. 22.
Figure 25:
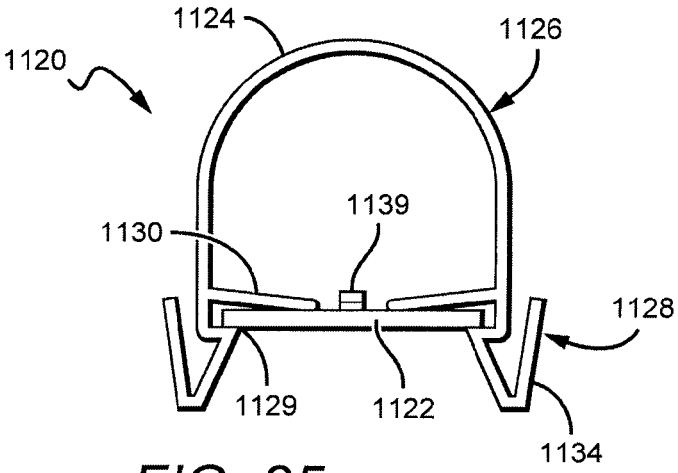
FIG. 25 is an end view of the light engine housing shown in FIG. 22.

The lens can also comprise various angular shapes. FIG. 18 depicts a light engine 950, similar to light engine 100, wherein the corresponding disclosure above is incorporated into this embodiment such that wherein like features share the same reference numbers. Light engine 950 comprises body 102, light sources 104, conductive elements 106, and lens 952. Lens 952 can comprise an angular surface, for example, lens 952 can be triangular or pyramidal. FIG. 19 depicts a light engine 1000, similar to light engine 100, wherein the corresponding disclosure above is incorporated into this embodiment such that like features share the same reference numbers. Light engine 1000 comprises body 102, light sources 104, lens 1002, and conductive elements 106. Lens 1002 can also comprise multiple instances of a angular features (two shown). Lens 1002 can also comprise shapes and configurations that combine one or more instances of angular and rounded features such as comprising conical or trapezoidal surfaces.

It is understood that although specific shapes and configurations of lens embodiments are discussed above, these are only possible embodiments and the lens can comprise a wide variety of other shapes.

The lens can also be structurally configured to hold additional components in place, such as light sources, reflective elements and conductive elements. FIG. 20 depicts a light engine 1050, similar to light engine 100, wherein the corresponding disclosure above is incorporated into this embodiment such that like features share the same reference numbers. Light engine 1050 comprises body 102, light sources 104, conductive elements 106, reflective element 126 and lens 1052. One such way in which lens 1052 can be configured to hold additional components in place is by forming additional structures, for example, tabs 1054, on its inner surface wherein tabs 1052 interact with the additional components such that they can be held in place. Tabs 1054 can hold many different components into place, for example, light sources 104, conductive elements 106 and/or reflective element 126. Tabs 1054 can be the primary means of holding the components in place, can interact cooperatively with other structures to hold components in place or can serve as a secondary means or support structure to further secure components in place. In one embodiment, light sources 104, conductive elements 106 and reflective element 126, are formed as a subassembly and are held in place by tabs 1054. In another embodiment, tabs 1054 can be reflective, for example reflective white, and can take the place of reflective element 126 or be used in addition to reflective element 126. In embodiments wherein tabs 1054 are reflective, flex circuits, which typically cannot be coated with a highly reflective material, can be efficiently utilized as conductive elements 106.

FIG. 21 depicts a light engine 1100, similar to light engine 100, wherein the corresponding disclosure above is incorporated into this embodiment such that like features share the same reference numbers. Light engine 1100 comprises body 1102, light sources 104, conductive elements 106, connecting portions 112, lens 1104 and an internal lighting element having a reflective element 126. FIG. 21 shows body 1102 further comprising grooved portions (or channels) 1106 which can receive a light engine component, such as reflective element 126. FIG. 21 also shows lens 1104 comprising tabs 1108 which can help secure light engine components in place. Grooved portions 1106 and tabs 1108 can cooperate to hold a light engine component in place, such as reflective element 126 as shown. Like the embodiments above, the lens 1104 can comprise any light transmissive material, and can also have materials or features for directing, scattering, focusing, or altering the direction and/or nature of the emitted light. This can include phosphors or scattering materials in the lens material, or structures to enhance light extraction. One or more surfaces 1110 and/or the entirety of tabs 1108 can be reflective to further increase light extraction of light engine 1100.

The embodiment depicted in FIG. 21 shows lens 1104 formed integral to body 1102 such that the lens contributes to the rigid structure of body 1102. This lens 1102 and 1104 can be formed using different methods such as extrusion and injection molding, and in the case where the body comprises different materials (e.g. transmissive and reflective materials) the two can be formed together through a co-extrusion process.

FIG. 22-25 show another embodiment of a light engine 1120 according to the present invention with comprising internal lighting element 1122 and a light engine housing 1124 that are also configured according to the present invention. As with the embodiment shown above, the light engine housing 1124 comprises a lens portion 1126 and a body portion 1128. Like the embodiments above, the housing 1122 can also comprise a grooved portions (or channels) 1129, and tabs 1130 to hold the internal lighting element 1122 in place as discussed above. In some embodiments, the lighting element can comprise a reflective element, conductive elements, and LEDs as described above.

In this embodiment, the housing has an integrated transmissive portion and a reflective portion, with the transmissive portion and reflective portions formed together as one piece during manufacturing. In some embodiments, the lens portion 1126 can comprise the transmissive portion and can be transmissive of the light emitted from the lighting element. The body portion 1128 can comprise the reflective portion and can be reflective to the light from the lighting element. In the embodiment shown, the transmissive portion begins generally at the portion of the housing 1122 that is above the tabs 1130, while the tabs and anything below comprise a reflective material. In this embodiment, the emitters 1132 (best shown in FIG. 25) on the lighting element 1122 are directed up so that their light transmission is primarily through the transmissive lens material. Light emitted toward the tabs 1130 or other portion of the body can be reflected so that is can contribute to the useful emission of the light engine.

As described above, housing 1122 can further comprise a connecting portion 1134 that enables light engine 1120 to interface with other structures for mounting of the light engine for operation. Connecting portion 1134 can be shaped or configured to allow for mounting of light engine 1120 to a lighting fixture, for example, for troffer retrofits or suspended light fixtures. In the embodiment shown, connecting portion 1134 comprises a self-connecting or self-coupling feature that allows it to be mounted to a lighting fixture without the need of fasteners or bonding materials. Many self-connecting features can be used, with the embodiment, shown comprising a "snap-fit" feature shaped configured to interact and cooperate with a corresponding or cooperating light engine mounting structure for mounting of light engine 1120. This can provide the flexibility of allowing the light engine to be removed from its mounting location by compressing the connecting portion and disengaging it from its corresponding structure. This allows for easy repair and replacement of the light engine.

The transmissive or lens portion 1126 can comprise any of the materials described herein and can be formed integral to the body 1128 by various processes such as co-extrusion or injection molding. The body can be formed of any materials described herein such as plastics, polymers and PC, with some of these materials being white. In other embodiments surfaces of the body, such as the tabs, can be coated with, or comprise, other reflective materials such as specular reflective or diffusing reflective materials. Forming integral lens and body portions allows for quick and inexpensive manufacturing of the housing 1122, and results in a robust and rigid housing structure. It is understood that other features of the light engine can be formed integral to the light engine housing through the co-extrusion process.

FIGS. 22-25 show only one embodiment of light engine housings 1122 that can have transmissive and reflective portions. In other embodiments the transmissive portion can be smaller, and may only comprise the very upper surface of the housing 1122, with the other portions comprising a reflective material. In other embodiments, the transmissive portion may even be smaller and can comprise a strip down the middle of the housing's top surface. Still other embodiments can have different shapes and designs for the transmissive portion.

Figure 26:
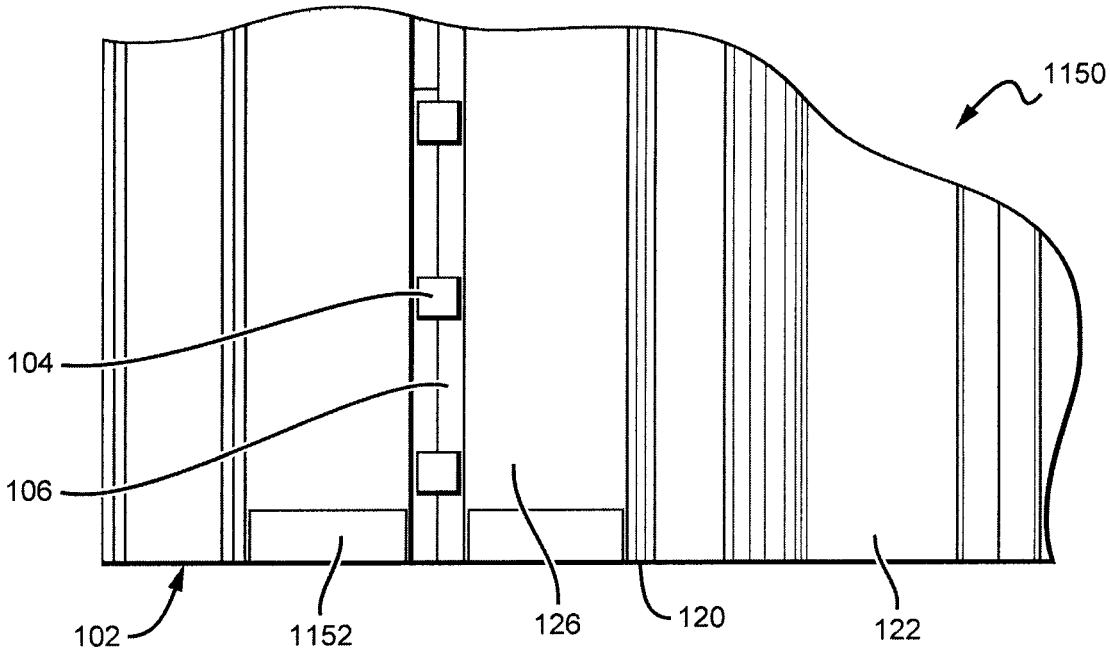
FIG. 26 is a top view of one embodiment of a light engine according to the present disclosure.

Devices according to the present disclosure can further comprises endcaps that can be either conductive or nonconductive and can interface with body 1102, lens 1104 or with the conductive elements 106, providing additional protection of internal components and providing a convenient means of providing external electrical connection of the light engine to outside elements. Body 1102 can also comprise additional structures to assist in increasing electrical tolerance or in interfacing with the endcaps. For example, FIG. 26 shows light engine 1150, similar to light engine 100, wherein the corresponding disclosure above is incorporated into this embodiment such that like features share the same reference numbers. Light engine 1150 comprises body 102, light sources 104, conductive elements 106, living hinge 120, lens 122 and reflective element 126. Light engine 1150 further comprises conductive "wings" 1152. Conductive wings 1152 can be placed and adhered to conductive elements 106, allowing for a larger tolerance for the endcap electrical connection.

Figure 27:
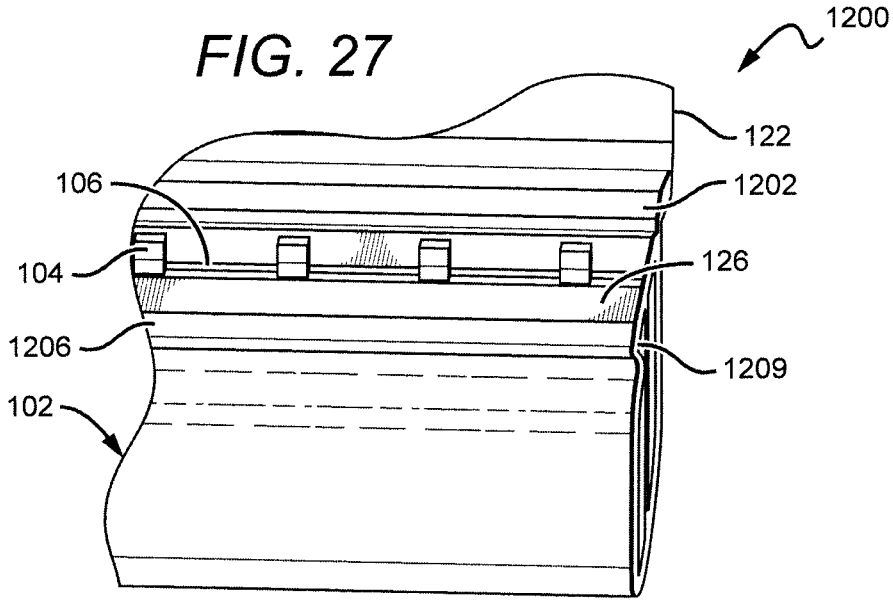
FIG. 27 is a side perspective view of one embodiment of a light engine according to the present disclosure.

The endcaps can be attached to body 102 by various methods including adhesives, snap fit, soldering and spring-loaded mechanisms. The endcaps can also be held in place by lens 122. FIG. 27 shows light engine 1200, similar to light engine 100, wherein the corresponding disclosure above is incorporated into this embodiment such that like features share the same reference numbers. Light engine 1200 comprises body 102, light sources 104, conductive elements 106, lens 122 and reflective element 126. Light engine 1200 further comprises endcap 1202. Endcap 1202 can be positioned on body 102 near the front edge 1204 of light engine 1900 (as shown) and/or the back edge 1206. Lens 122 can then be moved into a "closed" position as discussed above, folding over the endcap and closing, thus securing endcap 1202 in place. As mentioned above, lens 122 can contain additional structures or features, such as tabs on its internal surface, that allow it to interface with endcap 1202 and further secure it into a desired position.

Figure 28:
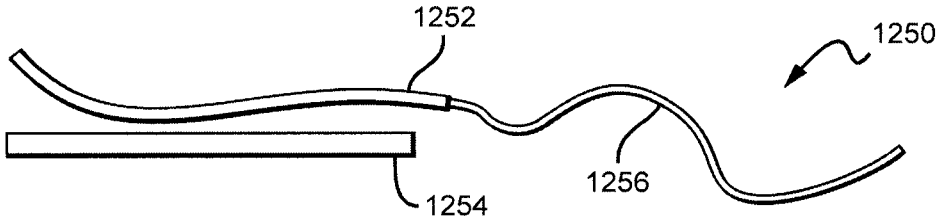
FIG. 28 is a schematic diagram of a spring loaded contact arrangement for use with an endcap according to the present disclosure.

FIG. 28 shows a schematic representation 1250 of a spring loaded contact arrangement showing spring loaded contact 1252 which can be formed integral to an endcap and can interface with an extruded light engine 1254. In this embodiment, spring loaded contact 1252 is extruded with light engine 1254. An external connection 1256 is then made to spring loaded contact 1252. External contact 1256 can be formed integral to spring loaded contact 1252 and or an endcap. In another embodiment, endcaps can be formed from a portion of the body (e.g. via machining) such that they are part of the body. Alternatively or in addition to endcaps to provide electrical connection to conductive elements, electrical connections, for example, conductive wires can be directly connected, soldered or adhered to conductive elements or additional structures such as wings.

Devices according to the present disclosure can be used in a variety of light fixtures, including troffer light fixtures or in retrofitting existing troffer fixtures with updated lighting components. FIG. 29 shows an example troffer assembly 1300 depicting light engines 1302, which are similar to light engine 100, power supply 1304, which can contain power supply cords (not shown) and mounting brackets 1306, which can retain the light engines and also route power supply cords from power supply 1304 to light engines 1302. It is understood that light engines according to the present disclosure can be utilized in a variety of lighting fixtures or as retrofits to existing fixtures and can be attached or integrated into such fixtures in a number of ways. Further examples of troffer assemblies and retrofits are described in detail in U.S. patent application Ser. No. 13/672,592, also assigned to Cree, Inc., which is hereby incorporated herein in its entirety by reference, including the drawings, charts, schematics, diagrams and related written description.

FIGS. 30 and 31 are temperature profile graphs comparing different embodiments of a light engine according to the present invention. FIG. 30 shows graph 1350 measuring temperature vs. current. FIG. 31 shows graph 1400 measuring temperature vs. individual LED power. The data was collected by attaching a thermalcouple to the center LED in a line of five electrically connected LEDs and measuring the temperature and forward voltage at various currents ranging from 20-100 milliamps (mA) over different materials used for the conductive elements of a light engine according to the present disclosure. The LEDs that were utilized were highly efficient LEDs as described above and were soldered onto the conductive elements. The four conductive elements that were tested are as follows: 1) an FR4 PCB with jumper wire connections (FR4 substrate with ½ oz copper) as a control; 2) 34 AWG copper wire rails; 3) 26 AWG copper wire rails; and Copper foil (3.1 mm×0.05 mm, adhesive backed (~1.5 oz)). Temperature and voltage were recorded at 10 mA increments.

FIG. 32 and FIG. 33 are additional graphs generated from data from the above data collection. FIG. 32 shows graph 1450 charting thermal resistance vs. current in relation to different conductive element materials mentioned above. FIG. 33 shows graph 1500 charting the relationship between thermal resistance vs. heat dissipation area measured over the range of 20-100 mA. The heat dissipation area measured in the above data collections roughly corresponds to Pi*diameter of the conductive element. This heat dissipation area 1550 is shown in FIG. 34, which depicts conductive element arrangement 1552, wherein the individual LEDs 1554 are attached to the conductive elements 1556 with heat dissipation area 1550 roughly corresponding to half distance between adjacent LEDs.

Referring again to FIGS. 30-33, these graphs show a temperature rise due to exposed heat dissipation area. This data demonstrates that conductive elements according to the present disclosure, coupled with highly efficient LEDs as discussed above can eliminate the need for a heat sink; if the temperature stays under 100° C., light engines according to the present invention could be manufactured more cost effectively than PCB based engines utilizing heat sinks. While highly efficient LEDs were used for these data collections, it is understood that other light sources with heat dissipating features or the ability to operate at lower drive currents and consume less power could be used in conjunction with rigid body 102 to eliminate both the heat dissipation and structural needs of a heat sink.

As discussed above, devices according to the present disclosure can be manufactured through efficient methods that reduce manufacturing time and cost. Referring again to FIG. 1, in one embodiment, body 102 is coextruded with reflective element 126 and cover 114, resulting in cover 114 being attached to body 102 via living hinge 120. Conductive elements 106 are then placed into position on the top portion of body 102. Alternatively or in addition, conductive elements 106 can be coextruded with body 102, reflective element 126 and cover 114, or added during the coextrusion process. Light sources, such as LEDs, are then bonded to the conductive traces via bonding methods as described above. Cover 114 can then be snapped into place. As already discussed above, various features may be included or excluded and added during different times in the process. For example, cover 114 can be formed separately and later snapped into place or reflective element 126 can.

It is understood that the present disclosure relates to light engines with integrated features intended to replace one or more commonly required or desired features. Accordingly, embodiments according to the present disclosure may contain such features such as a PCB, heat sink, separate lens/cover portion and/or reflective element. Likewise, embodiments according to the present disclosure can contain a PCB and no heat sink, and/or a heat sink and no PCB, a PCB and heat sink but an integrated cover/lens. These and various other combinations will be apparent to those of ordinary skill in the art after considering the present disclosure.

It is understood that the present disclosure relates to devices that can eliminate the need for various components, but that the devices disclosed herein can also utilize these components. For example, a device according to the present disclosure can eliminate the need for a heat sink, but still utilize a PCB, or eliminate the need for a PCB and still utilize a heat sink. Likewise, devices according to the present invention may utilize an integrated cover/lens but a separate reflective element.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A light engine, comprising:

an elongated housing comprising an integrated lens and at least one reflective body portion; and an elongated lighting element internal to said elongated housing comprising solid state emitters, wherein said solid state emitters are on said reflective body portion and positioned to emit a majority of light such that said light initially impinges on said integrated lens when said lens is in a closed position.

2. The light engine of claim 1, wherein said integrated lens and said at least one reflective body portion are coextruded.

3. The light engine of claim 1, wherein said integrated lens is light transmissive.

4. The light engine of claim 1, wherein said at least one reflective body portion comprises sloped portions.

5. The light engine of claim 1, wherein said elongated lighting element comprises conductive elements integrated with said housing and in communication with said solid state emitters, said conductive elements comprising electrical pathways between said solid state emitters.

6. The light engine of claim 1, wherein said solid state emitters comprise LED packages with heat dissipating features.

7. The light engine of claim 6, wherein said at least one reflective body portion is coextruded with said integrated lens.

8. The light engine of claim 1, wherein said elongated lighting element comprises LEDs and a reflective element.

9. The light engine of claim 1, wherein said elongated lighting element comprises conductive elements.

10. The light engine of claim 1, wherein said elongated housing further comprises a connecting portion to allow for attachment of said light engine to other objects.

11. The light engine of claim 10, wherein said connecting portion is self-coupling.

12. A light engine, comprising:

an elongated housing comprising a co-extruded transmissive upper portion and a reflective portion, wherein said transmissive upper portion is movable between an open position and a closed position; and light emitting diodes (LEDs) within said housing such that said LEDs are on said reflective portion and positioned to emit a majority of light such that said light initially impinges on said transmissive upper portion when said lens in is said closed position.

13. The light engine of claim 12, further comprising conductive elements forming electrical pathways between said LEDs.

14. The light engine of claim 12, further comprising a reflective element internal to said elongated housing.

15. The light engine of claim 14, wherein said reflective element is coextruded with said elongated housing.

16. The light engine of claim 12, wherein said elongated housing further comprises a connecting portion to allow for attachment of said light engine to other objects.

17. The light engine of claim 16, wherein said connecting portion is self-coupling.

18. A light fixture comprising:

a light engine, comprising:

an elongated housing comprising integrated lens and reflective body portions;

an elongated lighting element internal to said elongated housing, wherein said elongated housing comprises at least one elongated connecting portion configured to cooperate with an external mounting structure enabling connection along the length of said elongated housing, said at least one connecting portion integrated with said elongated housing.

19. The light fixture of claim 18, wherein said at least one connecting portion and said light engine mounting structure cooperate to mount said light engine in its operation location.

20. The light fixture of claim 18, wherein said at least one connecting portion comprises a self-connecting feature.

21. The light fixture of claim 18, wherein said at least one connecting portion comprises a snap fit feature.

* * * * *